US006160969A

United States Patent [19]

Ishigaki et al.

[11] Patent Number: 6,160,969

[45] Date of Patent: Dec. 12, 2000

[54] IMAGE FORMING APPARATUS WITH A VOLTAGE APPLYING UNIT FOR IMAGE TRANSFER

[75] Inventors: Kouji Ishigaki, Kanagawa; Haruji Mizuishi, Tokyo; Masaru Tanaka, Kanagawa; Hiroyuki Ohkaji, Kanagawa; Kenzou Tatsumi, Kanagawa; Hiroshi Mizusawa; Ken Amemiya, both of Tokyo; Hideki Zenba; Mayumi Ohori, both of Kanagawa, all of Japan

[73] Assignee: Ricoh Company, Ltd., Tokyo, Japan

[21] Appl. No.: 09/134,832

[22] Filed: Aug. 17, 1998

[30] Foreign Application Priority Data

| | | | |
|---|---|---|---|
| Aug. 18, 1997 | [JP] | Japan | 9-236507 |
| Sep. 29, 1997 | [JP] | Japan | 9-281406 |
| Nov. 29, 1997 | [JP] | Japan | 9-344286 |
| Jul. 17, 1998 | [JP] | Japan | 10-219761 |

[51] Int. Cl.[7] ..... G03G 15/14

[52] U.S. Cl. ..... 399/49; 399/66; 399/313

[58] Field of Search ..... 399/49, 101, 313, 399/66

[56] References Cited

U.S. PATENT DOCUMENTS

| | | | |
|---|---|---|---|
| 4,619,522 | 10/1986 | Imai | 399/49 |
| 5,689,771 | 11/1997 | Sato et al. | 399/101 |
| 5,719,684 | 2/1998 | Ohkaji et al. | 358/300 |
| 5,822,649 | 10/1998 | Karashima et al. | 399/101 X |
| 5,828,927 | 10/1998 | Yoo et al. | 399/101 |
| 5,845,174 | 12/1998 | Yasui et al. | 399/101 |
| 5,857,132 | 1/1999 | Mizuishi et al. | 399/313 X |

FOREIGN PATENT DOCUMENTS

| | | |
|---|---|---|
| 0 738 938 | 10/1996 | European Pat. Off. . |
| 0 775947 | 5/1997 | European Pat. Off. . |
| 0 784 246 | 7/1997 | European Pat. Off. . |

*Primary Examiner*—Fred L. Braun

*Attorney, Agent, or Firm*—Oblon, Spivak, McClelland, Maier & Neustadt, P.C.

[57] ABSTRACT

An image forming apparatus transfers a toner image from a photoconductive image carrier to a recording medium with a transfer roller and senses the density of a particular toner pattern formed on the image carrier with an optical sensor. A voltage of a first polarity opposite the polarity of the toner is applied to the transfer roller when the toner image is to be transferred to the recording medium. A voltage of a second polarity identical to the polarity of the toner is applied to the transfer roller when the toner pattern is to be moved between the image carrier and the transfer roller. Thus, even when a toner pattern is brought to the transfer roller, the transfer roller is not released from the photoconductive element.

27 Claims, 22 Drawing Sheets

(a) DRIVE MOTOR
(b) MIRROR MOTOR
(c) LASER BEAM
(d) CHARGE OUTPUT
(e) DEVELOP BIAS
(e) DEVELOP ROLLER
(f) TRANSFER(+) OUTPUT
(g) TRANSFER(−) OUTPUT
(h) SENSOR
(i) REPLENISH MOTOR
SYNC DETECTION
L
STOP
ROTATE
t
TONER REPLENISHMENT
TONER REPLENISHMENT CYCLE
T1

IMAGE FORMING APPARATUS WITH A VOLTAGE APPLYING UNIT FOR IMAGE TRANSFER

BACKGROUND OF THE INVENTION

The present invention relates to an image forming apparatus of the type forming a toner image on an image carrier and then transferring it to a paper or similar recording medium by use of a transfer member.

An electrophotographic copier, a printer, a facsimile and a multiplex machine having at least two of their functions belong to a family of image forming apparatuses of the type described. This type of image forming apparatus includes a transfer member which is usually of non-contact type spaced from an image carrier or of contact type contacting the image carrier. Typical of the contact type transfer member is a transfer roller, a transfer belt, a transfer brush or a transfer blade. When a toner image is to be transferred to a recording medium moving between the transfer member and the image carrier, a voltage opposite in polarity to toner forming the toner image is applied to the contact type transfer member. The resulting electric field allows the toner image to be transferred from the image carrier to the recording medium.

With the contact type transfer member, it is possible to reduce ozone at the time of transfer of the toner image and to reduce the dislocation of the toner image on the recording medium. Many of modern image forming apparatuses therefore use the contact type transfer member. The present invention is also directed toward this kind of image forming apparatus.

It is a common practice with the above image forming apparatus to form a particular toner pattern on the image carrier, sense the density of the toner pattern with density sensing means including a density sensor, determine the condition of the apparatus on the basis of the sensed image density, and control the various factors of the apparatus to adequate conditions for the formation of a toner image. For example, when the developing device for forming a toner image on the image carrier stores a two-ingredient type developer, i.e., toner and carrier mixture, the toner content of the developer is sensed in terms of the density of the toner pattern. If the toner density is determined to be low, then fresh toner is replenished into the casing of the developing device.

However, assume that the toner pattern is formed on the image carrier in the image forming apparatus of the kind using the contact type transfer member. Then, when the toner pattern is brought to the transfer member, toner forming the toner pattern deposits on the transfer member. As a result, it is likely that when the recording medium is conveyed between the image carrier and the transfer member, the toner deposited on the transfer member is transferred to the rear of the recording medium and smears it.

In light of the above, it has been customary to release the transfer member from the image carrier when the toner pattern is brought to the transfer member, thereby preventing the toner of the toner pattern from depositing on the transfer member. This approach, however, needs an exclusive mechanism for moving the transfer member into and out of contact with the image carrier and including a solenoid and a clutch. Such a mechanism increases the overall size and cost of the image forming apparatus.

SUMMARY OF THE INVENTION

It is therefore an object of the present invention to provide an image forming apparatus making it needless to release a transfer member from an image carrier when a particular toner pattern formed on the image carrier is brought to the transfer member.

An image forming apparatus of the present invention includes an image carrier driven such that its surface moves. A latent image forming section forms a latent image representative of a document and a latent image representative of a particular pattern on the image carrier. A developing device develops the latent image representative of the document image and the latent image representative of the particular pattern to thereby produce a corresponding toner image and a corresponding toner pattern, respectively. A transfer member contacts the surface of the image carrier via a recording medium for transferring the toner image from the surface of the image carrier to the recording medium. A density sensor senses the density of the toner pattern formed on the surface of the image carrier. A voltage applying circuit applies, when the toner image is to be transferred from the surface of the image carrier to the surface of the recording medium being moved between the image carrier and the transfer member, a voltage of first polarity opposite to the polarity of the charge of toner forming the toner image to the transfer member or applies, when the toner pattern is to be moved between the image carrier and the transfer member contacting the surface of the image carrier, a voltage of second polarity identical with the charge polarity of toner forming the toner pattern to the transfer member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
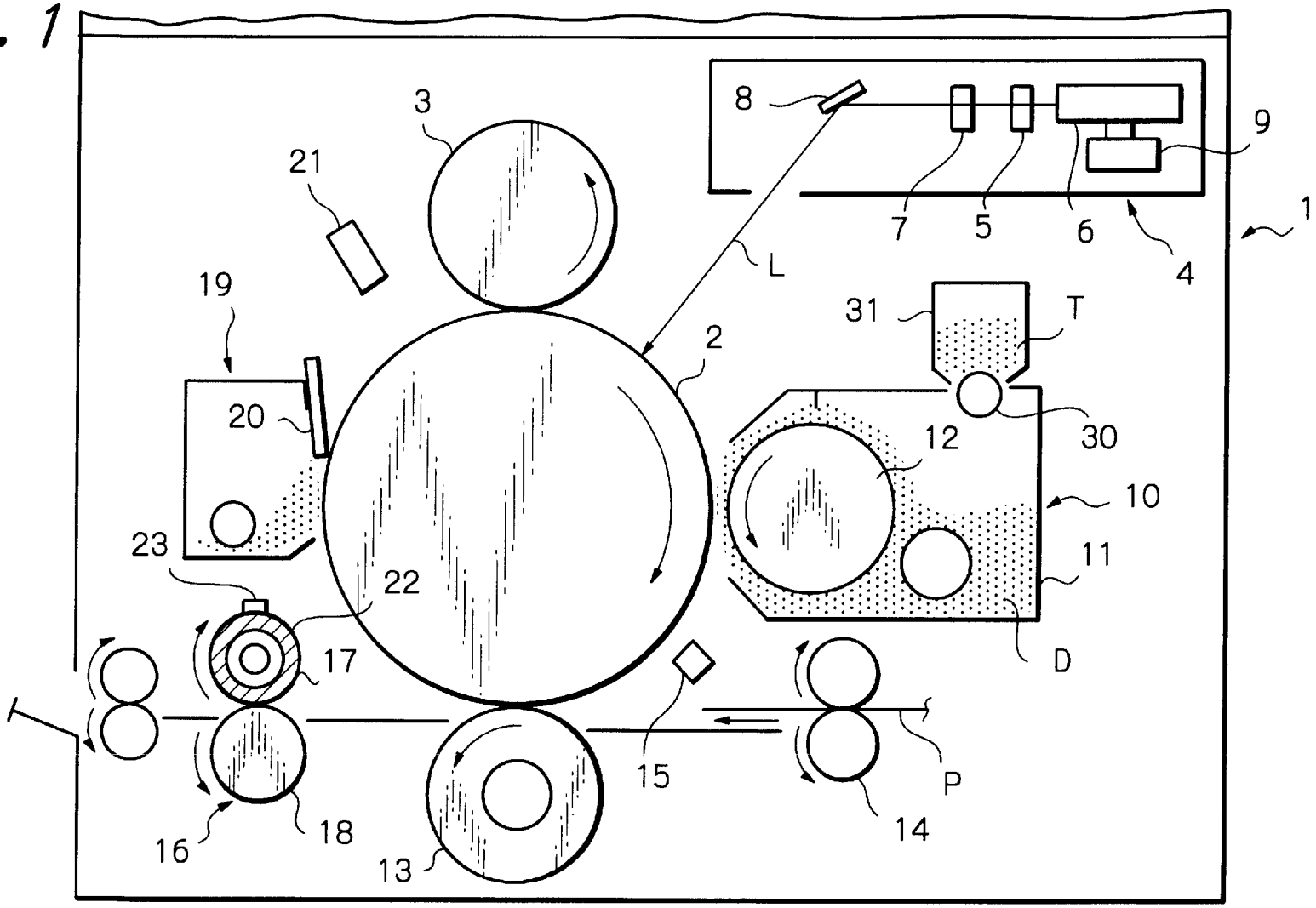
FIG. 1 is a section showing an image forming apparatus embodying the present invention.

Referring to FIG. 1 of the drawings, an image forming apparatus embodying the present invention is shown. As shown, the image forming apparatus includes a photoconductive element or image carrier in the form of a drum 2. Latent image forming means uniformly charges the surface of the drum 2 to a preselected polarity and includes a charge roller 3 and an optical writing device 4. A developing device 10 develops a latent image formed on the drum 2. An optical sensor 15 plays the role of a density sensor. A transfer roller 13 is a specific form of a contact type image transfer member. Voltage applying means, which will be described later, is also included in the image forming apparatus.

On the power-up of the apparatus, a drive motor, not shown, causes the drum 2 to rotate clockwise, as viewed in FIG. 1. The charge roller 3, contacting the surface of the drum 2, is rotated counterclockwise by the drum 2. At this instant, a voltage of preselected polarity is applied to the charge roller 3. As a result, the surface of the drum 2 is charged to a preselected polarity, i.e., negative polarity in the illustrative embodiment. The surface potential of the drum 2 is, e.g., −850 V.

The optical writing device or exposing device 4 includes a laser 5. A polygonal mirror 6 steers an optically modulated laser beam issuing from the laser 5 by being rotated by a mirror motor 9. The laser beam reflected by the polygonal mirror 6 is incident to a mirror 8 via an f-θ lens. The laser beam, labeled L, reflected by the mirror 8 scans the charged surface of the drum 2 and thereby forms an electrostatic latent image in accordance with image data. The surface portion of the drum 2 scanned by the laser beam has its potential lowered to, e.g., −200 V, constituting the latent image. The other portion of the drum 2 not scanned by the laser beam maintains a potential of about −850 V, constituting a background.

The developing device 10 develops the latent image with toner when the latent image is conveyed thereto by the drum 2, thereby forming a corresponding toner image on the drum 2. In the illustrative embodiment, the developing device 10 includes a casing 11 storing a two-ingredient type developer D. A developing roller 12 is disposed in and rotatably supported by the casing 11. During development, the developing roller 12 is rotated counterclockwise, as viewed in FIG. 1. Toner and carrier constituting the developer D are charged to opposite polarities due to friction; in the illustrative embodiment, the former is charged to negative polarity while the latter is charged to positive polarity. When the developing roller 12, accommodating a magnet, not shown, therein, is rotated, the developer D is magnetically deposited on the surface of the roller 12 and conveyed thereby to a developing region between the roller 12 and the drum 2. A preselected bias voltage, i.e., −600 V in the illustrative embodiment is applied to the developing roller 12. As a result, the toner of the developer D is electrostatically transferred from the developing roller 12 to the latent image carried on the drum 2 due to a difference between the surface potential of −200 V of the latent image and the potential of the roller 12, i.e., an image forming potential of 400 V. The latent image therefore turns out a toner image.

As stated above, in the illustrative embodiment, the image carrier is implemented by a negatively chargeable organic photoconductor while the developer is implemented by a two-ingredient type developer including negatively chargeable toner.

A paper feeding device, not shown, feeds a paper or similar recording medium P. A registration roller pair 14 once stops the paper P and then drives it to a nip between the drum 2 and the transfer roller 13 at a preselected timing. The transfer roller 13 is made up of a shaft formed of conductive metal and an elastic surface layer formed on the shaft.

The transfer roller 13 is held in contact with the drum 2 under a preselected pressure and moved in the same direction as the drum 2, as seen at the position where the roller 13 and drum 2 contact each other. When the paper P is passed through a transfer region between the transfer roller 13 and the drum 2, a voltage opposite in polarity to the charge of the toner forming the toner image on the drum 2, i.e., a positive voltage in the illustrative embodiment is applied to the transfer roller 13. In this condition, an electric field causing the toner to be transferred from the drum 2 to the paper P is formed between the drum 2 and the transfer roller 13. As a result, the toner image is transferred from the drum 2 to the paper P. The paper P with the toner image is separated from the drum 2 by a separating device not shown.

In this manner, the transfer roller or transfer member 13 contacts the drum or image carrier 2 via the paper P in order to transfer the toner image from the drum 2 to the paper P. If desired, the transfer roller 13 may be replaced with a transfer belt, transfer brush, transfer blade or any other suitable contact type transfer member.

The paper P separated from the drum 2 is conveyed to a fixing device 16 including a heat roller 17 and a press roller 18. The heat roller 17 and press roller 18 fix the toner image on the paper P with heat and pressure. Finally, the paper P is driven out of the apparatus as a copy. The heat roller 17 and press roller 18 are so rotated as to drive the paper P out of the apparatus. A heater 22 is disposed in the heat roller 17 and implemented by a halogen heater by way of example. The temperature of the heat roller 17 is sensed by temperature sensing means including a thermistor or similar temperature sensor 23.

A cleaning device 19 includes a cleaning member 20. The cleaning member 20 removes the toner left on the drum 2 after the above image transfer. In the illustrative embodiment, the cleaning member 20 is implemented by an elastic cleaning blade whose edge contacts the surface of the drum 2. A discharge lamp 21 illuminates the cleaned surface of the drum 2 in order to lower its potential to a reference value.

As the above image forming operation is repeated, the toner of the developer D stored in the casing 11 is consumed and has its toner content reduced. In light of this, a particular toner pattern is formed on the drum 2 and has its density sensed. When the density of the toner pattern is determined to be low, toner is replenished into the developer D of the developing device 10. The particular toner pattern is formed in, e.g., an area on the drum 2 following the toner image in the direction of rotation of the drum 2 or at a particular timing not obstructing the formation of the toner image.

Specifically, at the start-up of the apparatus preceding the actual formation of the toner image on the drum 2, the latent image forming means and developing device 10 cooperate to form the particular toner pattern on the drum 2. For example, on the power-up of the apparatus, the heater 22 heats the fixing roller 17 to a preselected temperature suitable for fixation, e.g., around 180° C. under the control of the thermistor 23. When use is made of a 500 W to 800 W halogen heater, a warm-up time of about 20 seconds to 30 seconds is usually needed. The particular toner pattern is formed on the drum 2 during such a warm-up time. Alternatively, the toner pattern may be formed on the drum 2 during an interval between the operation of a copy start key, not shown, and the rise of the temperature of the heat roller 17 to a preselected temperature.

Figure 2:
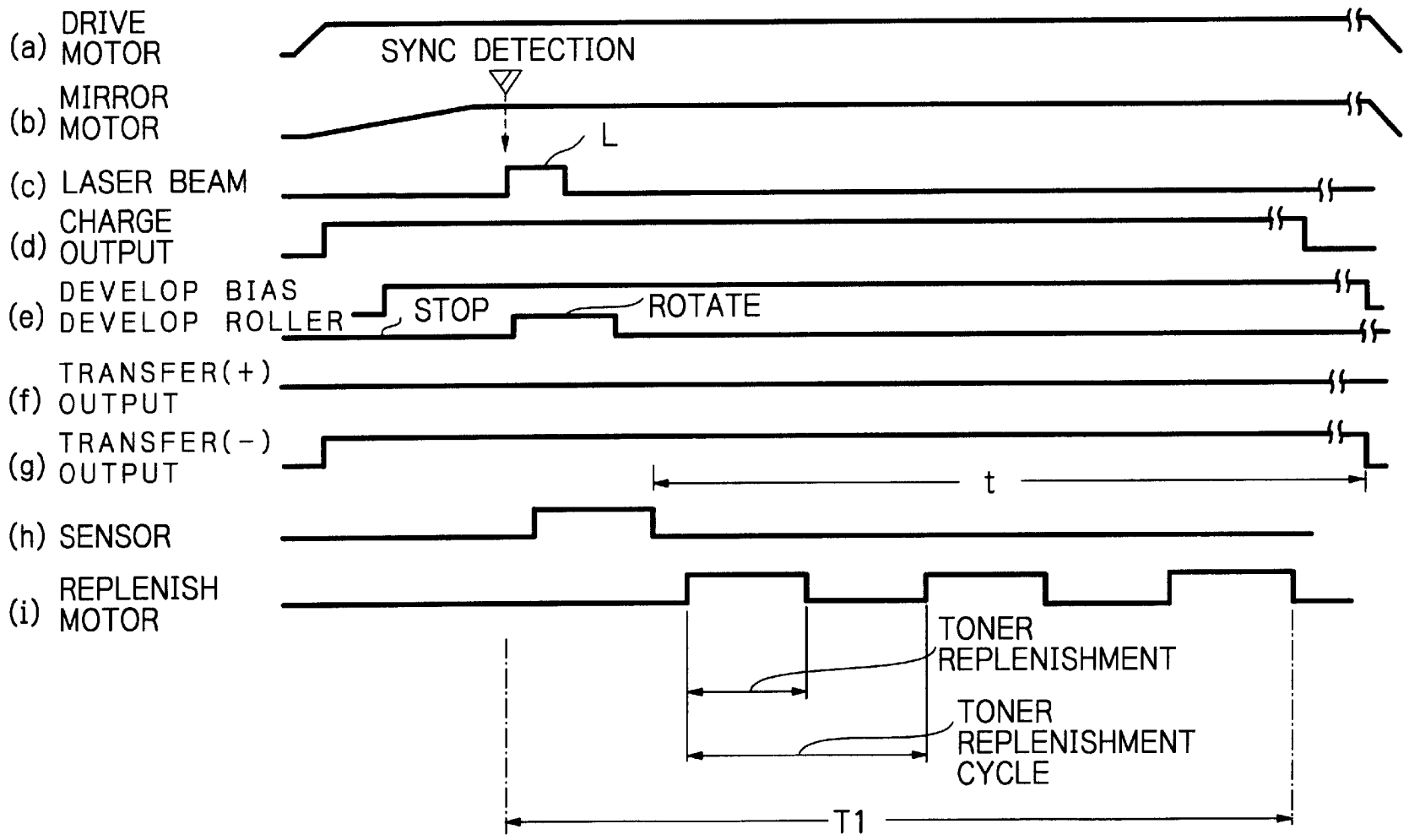
FIG. 2 is a timing chart showing a specific operation of the illustrative embodiment relating to the formation of a particular toner pattern.

FIG. 2 shows a specific procedure in which the particular toner pattern is formed during the warm-up time after the power-up of the apparatus. The procedure will be described with reference also made to FIG. 3. When a power-switch, not shown, provided on the apparatus is turned on, a brush motor or similar drive motor is energized and causes the drum 2 to start rotating clockwise, as viewed in FIG. 1 ((a), FIG. 2). At the same time, the mirror motor 9 is energized and causes the polygonal mirror 6 to start rotating ((b), FIG. 2). The negative voltage is applied to the charge roller 3 in order to uniformly charge the surface of the drum 2 to negative polarity ((d), FIG. 2). As soon as the rotation of the drive motor is stabilized and the mirror motor 9 is fully synchronized, the laser 5 emits a laser beam for a preselected period of time, as indicated by L in (c) of FIG. 2. As a result, a latent image representative of a particular pattern is formed on the drum 2. The surface potential of the drum 2 is, e.g., about −850 V when charged by the charge roller 3 or, e.g., about −200 V when scanned by the laser beam.

When the latent image representative of the toner pattern is conveyed by the drum 2 to the developing device 10, the developing roller 12 is caused to rotate ((e), FIG. 2) while the bias voltage is applied to the roller 12 ((e), FIG. 2). Consequently, the latent image is developed by the negatively charged toner in exactly the same manner as the previously stated latent image, turning out a particular toner pattern. This toner pattern may be an about 20 mm square, rectangular pattern. Specifically, the voltage applied to the developing roller 12 is also −600 V by way of example. The toner is deposited on the above latent image due to a difference between the voltage applied to the developing roller 12 and the surface potential of the latent image, i.e., an image forming potential. When the toner content of the developer D stored in the developing device 10 is high, a great amount of toner deposits on the latent image and increases the density of the resulting toner image. Conversely, when the toner content is low, only a small amount of toner deposits on the latent image and reduces the density of the toner image.

As shown in FIG. 1, the sensor 15 is positioned downstream of the developing device 10, but upstream of the transfer roller 13, in the direction of rotation of the drum 2. The sensor 15 is spaced from the surface of the drum 2. When the toner pattern is brought to the sensor 15, the sensor 15 reads the toner pattern and optically senses its density (step S1, FIG. 3). Specifically, the sensor 15 senses the density of the toner pattern when the toner pattern reaches a region downstream of a developing region assigned to the developing device 10, but upstream of a transfer region assigned to the transfer roller 13, in the direction of rotation of the drum 2.

Figure 4:
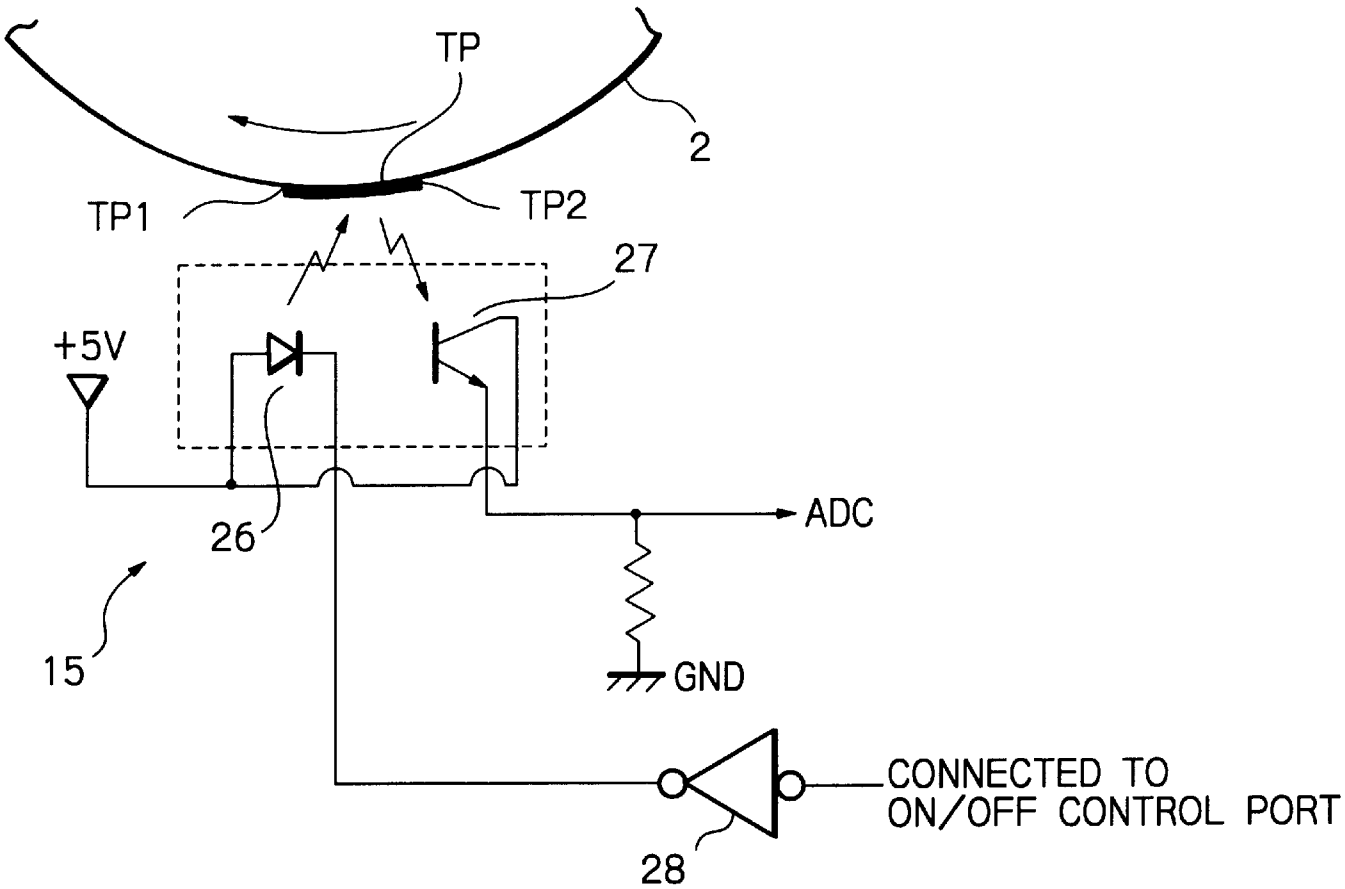
FIG. 4 shows a specific configuration of an optical sensor.

FIG. 4 shows a specific configuration of the optical sensor 15. As shown, the sensor 15 includes a light emitting device 26 implemented by an LED (Light Emitting Diode), a light-sensitive device 27 implemented by a phototransistor, and a control device 28 for ON/OFF controlling the light emitting device 26. When the toner pattern, labeled TP, on the drum 2 reaches a position where it faces the sensor 15, the control device 28 causes the light emitting device 26 to emit light ((h), FIG. 2). The resulting reflection from the toner pattern is incident to the light-sensitive device 27. The light-sensitive device 27 therefore outputs a voltage (or a current) representative of the quantity of incident light. This voltage is sent to an analog-to-digital converter (ADC) included in a CPU (Central Processing Unit) constituting a main controller 29 (see FIG. 5). As a result, the density of the toner pattern is determined. The sensor 15 and main controller 29 constitute the density sensing means mentioned earlier.

Figure 10:
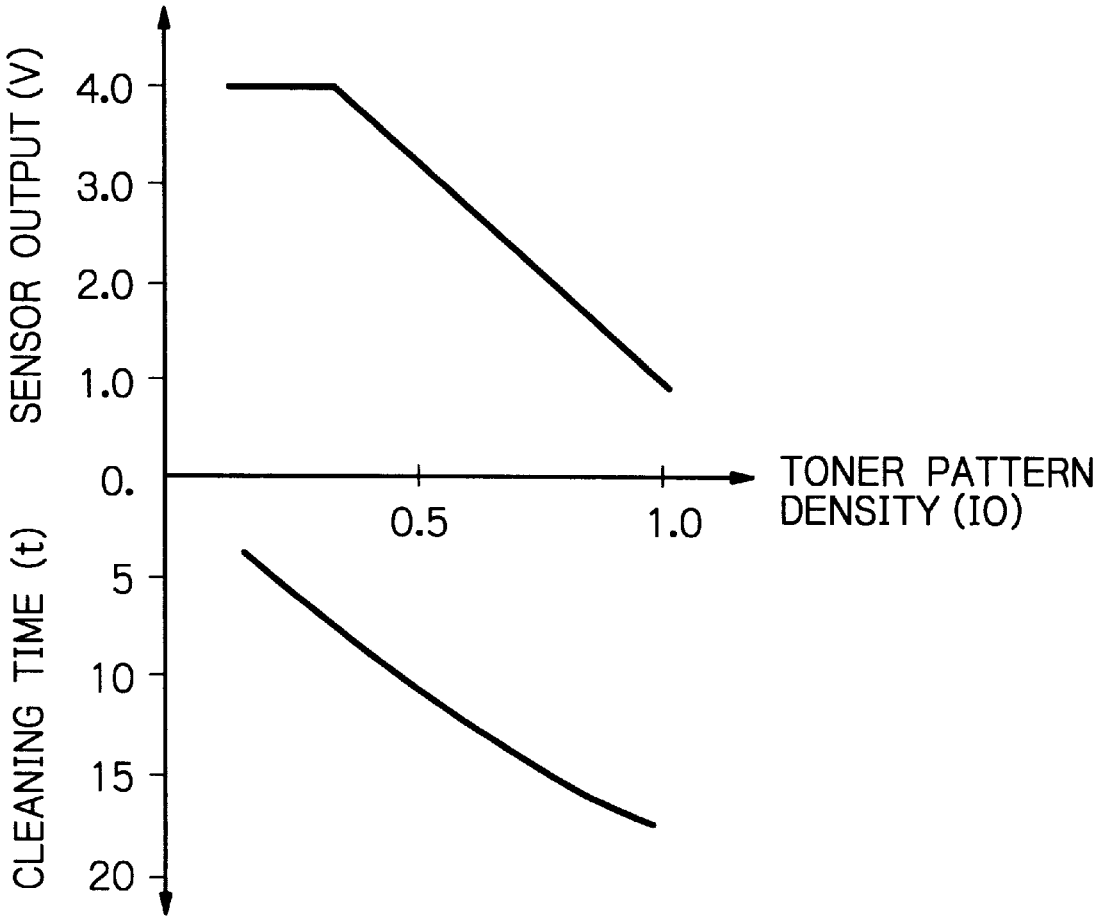
FIG. 10 is a graph showing a specific relation between the output of the optical sensor, the cleaning time assigned to the transfer roller, and the density of the toner pattern.

Assume that the toner content of the developer D stored in the developing device 10 and therefore the image density (simply density hereinafter) ID of the toner pattern is sufficiently high. Then, as shown in FIG. 10, the quantity of light reflected from the toner pattern is small, so that the output voltage of the light-sensitive device 27 is low. Conversely, when the toner content of the developer D and therefore the density ID is low, the output voltage of the light-sensitive element 27 is high.

When the output voltage of the light-sensitive device 27 rises above a preselected voltage, the main controller 29 determines that the toner content of the developer D has decreased. Then, the main controller 29 energizes a toner replenishing motor, not shown, ((i), FIG. 2) so as to rotate a toner replenishing roller 30 shown in FIG. 1. Consequently, toner T stored in a toner container 31 is replenished into the developer D existing in the casing 11. By such a procedure, the toner content of the developer D is maintained in a preselected range. In the illustrative embodiment, such toner replenishment is effected before a toner image or a plurality of toner images begin to be formed.

Assume that the sensor 15 outputs a voltage Vsp on reading the toner pattern, and that the voltage Vsp is 0.8 V when the toner content of the developer D is ideal. Then, in the specific operation shown in FIG. 3, toner is replenished when the voltage Vsp is higher than 1.5 V (steps S2 and S3, FIG. 3). For a single toner replenishing operation, the toner replenishing roller 30 is intermittently rotated three consecutive times, as also shown in (i) of FIG. 2. Specifically, when the voltage Vsp is higher than 1.5 V, the toner content of the developer D is expected to be noticeably low. Therefore, a great amount of toner is slowly replenished into the developer D. Why the roller 30 is rotated a plurality of times, e.g., three consecutive times for a single replenishing operation is that the toner might fail to be sufficiently mixed with the carrier if replenished in a great amount at a time. That is, the toner is replenished to the developing device 10 little by little in accordance with the agitating ability of the device 10.

Figure 3:
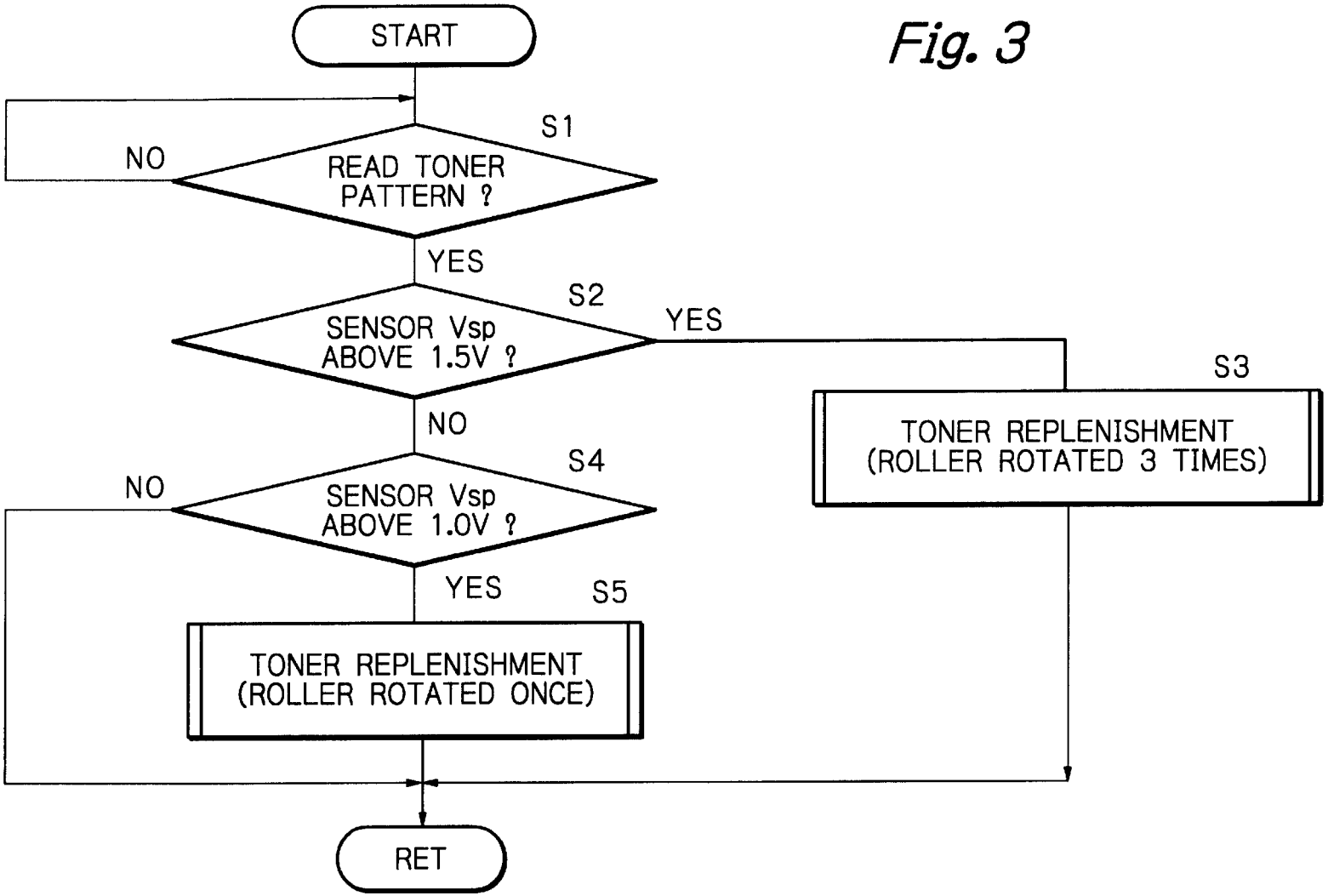
FIG. 3 is a flowchart associated with FIG. 2.

In the specific procedure shown in FIG. 3, when the output voltage Vsp of the sensor 15 is lower than 1.5 V, the main controller 29 determines whether or not the voltage Vsp is higher than 1.0 V (step S4, FIG. 3). If the answer of the step S4 is positive, then the main controller 29 determines that the density of the toner pattern is still low, and again executes the toner replenishment (step S5, FIG. 3). At this time, the toner replenishing roller 30 is rotated only once in order to replenish a small amount of toner to the developing device 10. If the voltage Vsp is lower than 1.0 V, then the main controller 29 determines that the toner content of the developer D is sufficiently high, and does not replenish any fresh toner.

As stated above, in the illustrative embodiment, toner replenishment is effected a plurality of consecutive times in accordance with the output voltage of the sensor 15. The duration of toner replenishment or the number of times of operation of the toner replenishing roller 30 is varied in order to implement adequate toner replenishment. The toner content of the developer D can therefore be accurately controlled, ensuring a toner image of high quality at all times.

In the above procedure, the sensor 15 senses the image density of the toner pattern. Alternatively, the sensor 15 may sense a quantity of light reflected from the toner pattern and a quantity of light reflected from the background where toner is absent. In such a case, the image density of the toner pattern will be determined on the basis of the ratio of the previously mentioned output voltage Vsp to an output voltage Vsg representative of the reflection from the background. When the ratio Vsp/Vsg exceeds a reference value, the main controller 29 determines that the toner content of the developer D has decreased, and replenishes toner to the developer D, as stated previously. As for the background, too, the sensor 15 senses the surface portion of the drum 2 charged to the preselected voltage by the charge roller 3 and moved away from the developing roller 12.

The toner pattern moved away from the sensor 15 arrives at the transfer roller 13. At this instant, if the transfer roller 13 is held in contact with the drum 2, then the toner forming the toner pattern is apt to deposit on the roller 13. Particularly, when the surface layer of the transfer roller 13 is implemented by a foam material, the toner penetrated into the dents of the surface of the roller 13 is apt to deposit on the rear of a paper being conveyed between the roller 13 and the drum 2. More specifically, because the transfer roller 13 is pressed against the drum 2, the portion of the roller 13 contacting the drum 2 is smaller in diameter than the other portion of the roller 13. Therefore, the dents in the portion of the transfer roller 13 contacting the drum 2 are deformed and puff out the toner. As a result, the toner deposits on the rear of the paper and smears it.

To solve the above problem, it has been customary to release the transfer roller 13 from the drum 2 before the toner pattern arrives at the nip between the roller 13 and drum 2. This kind of scheme, however, needs an exclusive transfer member moving device including a solenoid and a clutch and increases the size and cost of the image forming apparatus, as discussed earlier.

In the illustrative embodiment, even when the toner pattern arrives at the transfer roller 13, the transfer roller 13 is held in contact with the drum 2. At the same time, a voltage of the same polarity as the toner forming the toner pattern is applied to the shaft of the transfer roller 13. Specifically, for the transfer of a usual toner image from the drum 2 to a paper, the voltage applying means mentioned earlier applies a voltage of polarity (first polarity hereinafter) opposite to the polarity of the toner to the transfer roller 13. On the other hand, when the particular toner pattern arrives at the transfer roller 13, the voltage applying means applies a voltage of the same polarity as the toner (second polarity hereinafter) to the roller 13 ((g), FIG. 2).

The voltage of the same polarity as the toner and applied to the transfer roller 13, as stated above, forms an electric field preventing the toner from being transferred from the drum 2 to the transfer roller 13. As a result, despite that the transfer roller 13 is held in contact with the drum 2, the toner forming the toner pattern deposits on the roller 13 little. This eliminates the need for the conventional moving device for moving the transfer roller 13 into and out of contact with the drum 2, simplifying the construction of the image forming apparatus and reducing the cost of the apparatus.

Figure 5:
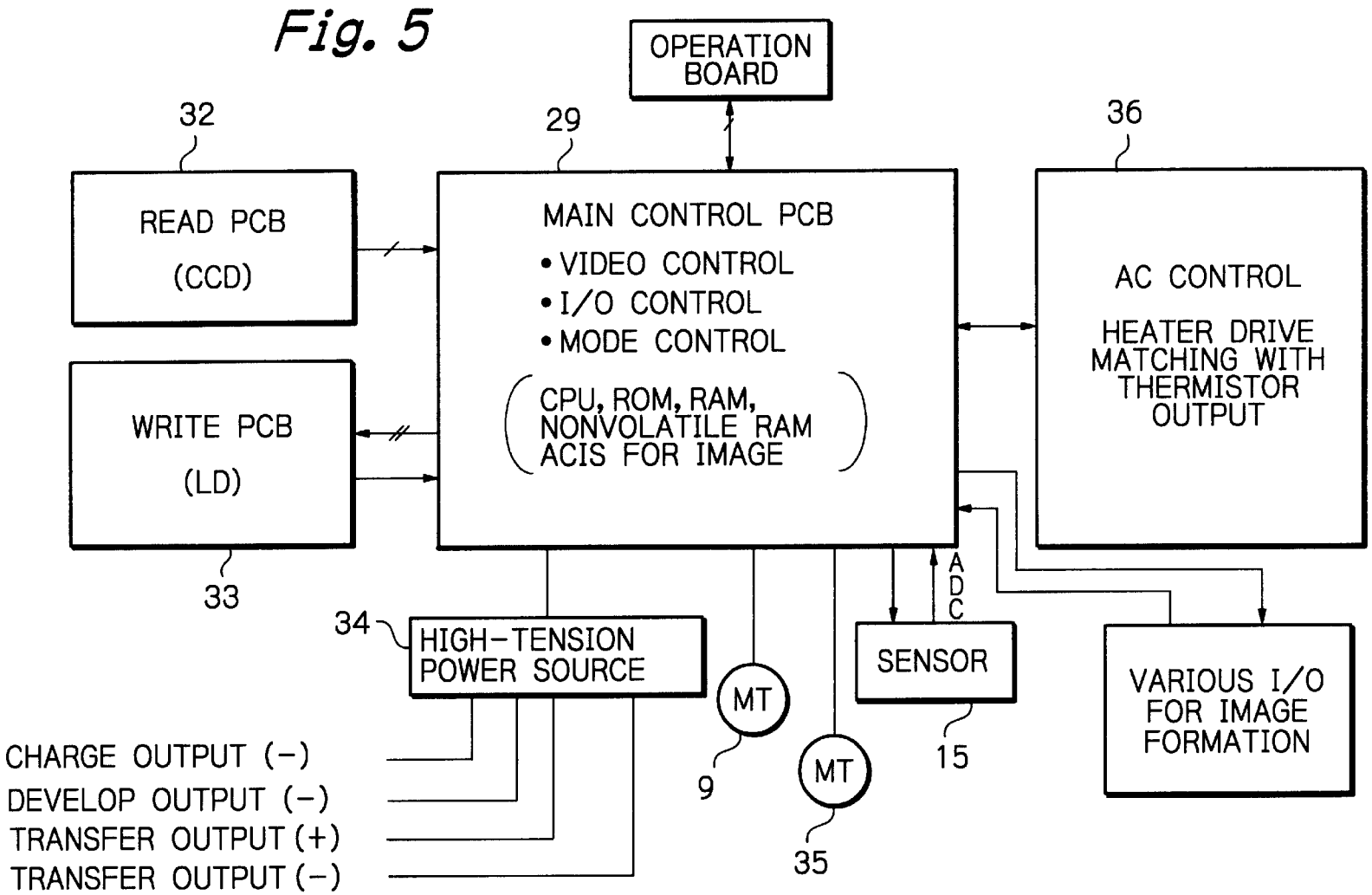
FIG. 5 is a block diagram schematically showing a control system included in the illustrative embodiment.

Referring to FIG. 5, the main controller 29 receives an image signal representative of a document image from a read PCB (Printed Circuit Board) 32 including a CCD (Charge Coupled Device) image sensor. The main controller 29, in turn, sends a write signal corresponding to the image signal to a write PCB 33 including the laser 5, FIG. 1. Also, the main controller 29 sends a pattern image form signal to the write PCB 33. In response, the write PCB 33 selectively forms on the drum 2 a latent image representative of the document image or a latent image representative of the particular toner pattern. A high-tension power source 34 applies, based on a signal output from the main controller 29, a preselected voltage of particular polarity to each of the charge roller 3, developing roller 12, and transfer roller 13. The mirror motor 9, a drive motor 35 for driving the drum 2, developing roller 12 and transfer roller 13, and the previously mentioned toner replenishing motor are rotated under the control of the main controller 29.

Specifically, the high-tension power source 34 includes switching means controlled by the main controller 29. The power source 34 applies the positive or negative voltage to the transfer roller 13, as stated earlier, and applies a voltage of particular polarity to each of the charge roller 3 and developing roller 12. A clutch, not shown, intervenes between the drive motor 35 and the developing roller 12 and causes the roller 12 to selectively start rotating or stop rotating. The output voltage of the sensor 15 is also input to the main controller 29 in order to determine the image density of the toner pattern, as stated earlier. The main controller 29 includes decision means for determining whether or not the image density of the toner pattern is lower than a preselected value. The decision means and sensor 15 constitute density sensing means. The voltage applying means including the power source 34 with the switching means applies the positive or negative voltage to the transfer roller 13, as stated previously.

As described above, the illustrative embodiment has the drum or image carrier 2, latent image forming means, developing device 10, transfer roller or transfer member 13, density sensing means, and voltage applying means each having the above function. Let this construction be referred to as a first construction.

In the above embodiment, the charge roller 3 and optical writing device 4 controlled by the main controller 29 constitute the latent image forming means. A latent image formed by the latent image forming means is developed by the developing device 10 also controlled by the main controller 29.

Assume the time when the leading edge of the toner pattern TP shown in FIG. 4, i.e., the most downstream edge TP 1 in the direction of rotation of the drum 2 reaches the nip between the drum 2 and the transfer roller 13, and the time when the trailing edge or most upstream edge TP 2 of the toner pattern TP moves away from the above nip. Let the interval between such two times be referred to as a contact interval. Then, during the contact interval, the operation stated earlier is practicable with the negative or positive voltage applied to the transfer roller 13 or without any voltage applied to the roller 13.

By contrast, in the specific procedure shown in FIG. 2, the voltage applying means continuously applies the negative voltage identical in polarity with the toner forming the toner pattern to the transfer roller 13 for a preselected period of time even after the trailing edge of the toner pattern has moved away from the roller 13 ((g), FIG. 2). That is, even after the toner pattern has moved away from the transfer roller 13, the voltage of the same polarity as the charge of the toner is applied to the roller 13, forming an electric field for transferring the toner from the roller 13 to the drum 2. It follows that even if the toner forming the toner pattern partly deposits on the transfer roller 13 due to the contact pressure between the roller 13 and the drum 2, it is electrostatically returned from the roller 13 to the drum 2 while the roller 13 is in rotation. That is, the transfer roller 13 smeared by the toner is cleaned during an interval t, FIG. 2, between the time when the trailing edge TP2 of the toner pattern moves away from the roller 13 and the time when the application of the negative voltage to the roller 13 ends.

As stated above, in the first construction, the above voltage applying means continuously applies the voltage of second polarity (negative polarity in the embodiment) to the transfer member 13 for a preselected period of time since the trailing edge of the toner pattern carried on the image carrier 2 has moved away from the transfer member 13. Let this construction be referred to as a second construction.

Whether the transfer member be implemented as the transfer roller 13 or a transfer belt or similar rotatable body passed over a plurality of pulleys, the toner deposited on the transfer member can be returned to the drum 2 over the entire periphery. This can be done if the voltage of second polarity is continuously applied to the transfer member at least over one rotation of the transfer member after the trailing edge of the toner pattern has moved away from the transfer roller 13. As a result, the transfer member is fully cleaned during the interval t, FIG. 2, and can be cleaned more positively. Assume that both the drum 2 and transfer roller 13 move at the same linear velocity Vp, and that the transfer roller 13 has a radius r. Then, the voltage of the same polarity as the charge of the toner is continuously applied to the transfer roller 13 at least for a period of time represented by $2\pi r/Vp$ since the leading edge of the toner pattern has moved away from the transfer roller 13.

As stated above, in the first and second constructions, the above voltage applying means continuously applies the voltage of second polarity to the transfer member at least over one rotation of the transfer member after the trailing edge of the toner pattern has moved away from the transfer member or rotatable body rotatable in contact with the image carrier. Let this construction be referred to as a third construction.

Assume that many papers P are passed through the nip between the transfer roller 13 and the drum 2, and that the toner forming the toner pattern and the toner deposited on the background frequently deposit on the transfer roller 13. Then, the surface of the transfer roller 13 is deteriorated due to aging. As a result, it is likely that the application of the voltage of second polarity to the transfer roller 13 effected for the above particular period of time fails to fully clean the surface of the transfer roller 13 alone. To solve this problem, the duration of the voltage of second polarity, i.e., the cleaning time may be increased or the voltage itself may be increased in accordance with the degree of deterioration of the transfer roller 13, as will be described specifically later.

Generally, however, the image forming apparatus is used in various environmental conditions, and each user uses the apparatus in a particular condition. Therefore, the degree of deterioration of the transfer roller 13 is not constant. It follows that when and how the above cleaning condition should be varied cannot be unconditionally determined.

The above problem can be solved by the following arrangement. After the application of the voltage of second polarity to the transfer roller 13 effected during at least one rotation of the transfer roller 13, the sensor 15 is caused to determine how much toner has been returned from the transfer roller 13 to the drum 1. If the toner is left on the transfer roller 13 in a great amount, then the transfer roller 13 is again cleaned. With this scheme, it is possible to surely clean the transfer roller 13 even when the roller 13 is deteriorated.

Figure 6:
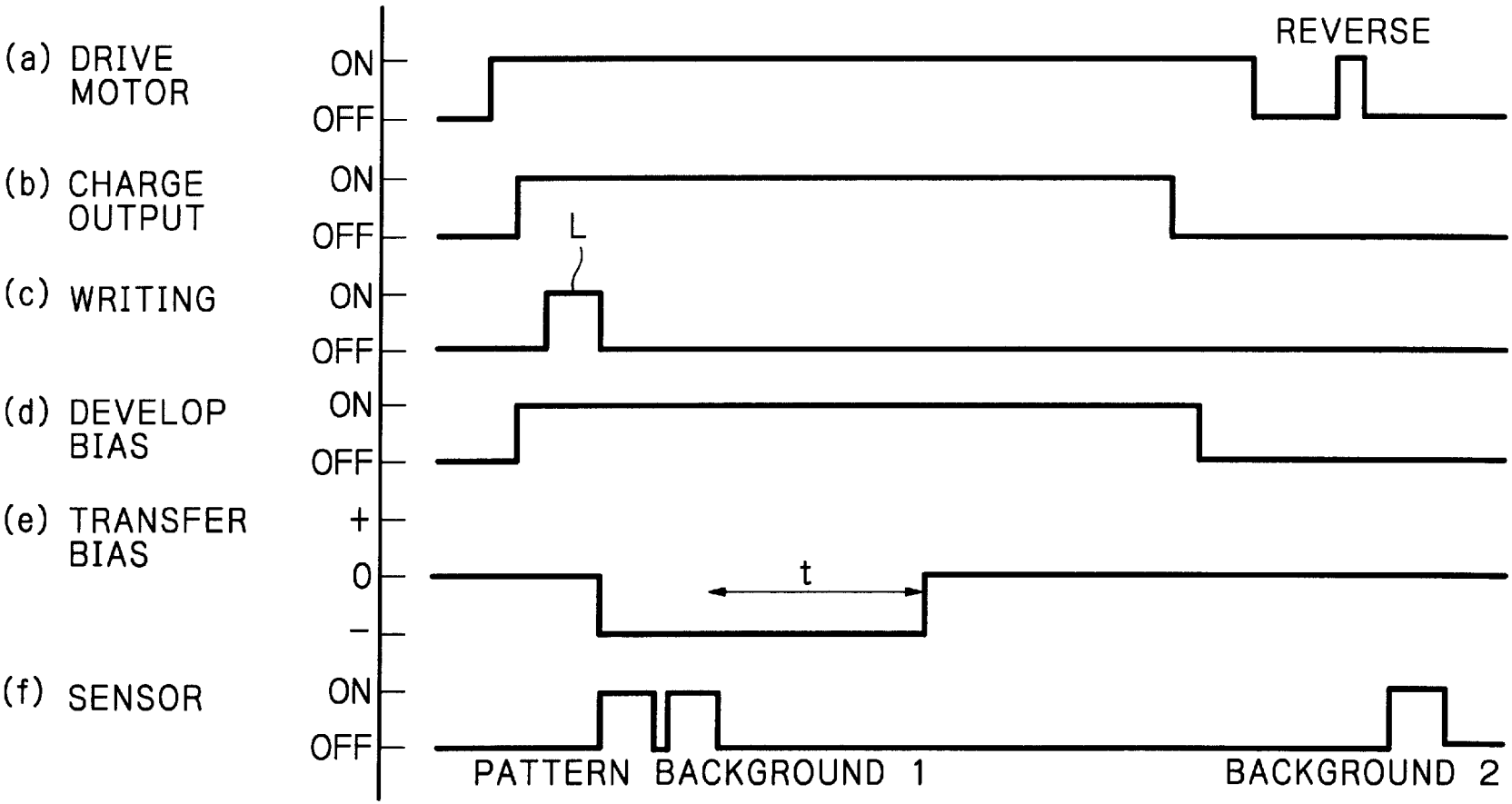
FIG. 6 is a timing chart different from the timing chart of FIG. 2.

FIG. 6 shows a specific procedure implementing the above scheme. The procedure, like the procedure of FIG. 2, forms the toner pattern during the warm-up time following the power-up of the apparatus. As shown, after the turn-on of the drive motor or main motor, the charge roller 3 charges the drum 2 to negative polarity ((b), FIG. 6). The laser beam scans the charged surface of the drum 2 for a preselected period of time L ((c), FIG. 6) so as to form a latent image representative of the particular pattern. The developing roller 12 applied with the bias voltage develops the latent image and thereby forms the toner pattern. The sensor 15 senses the reflection density of the toner pattern (labeled Pattern in (f) of FIG. 6) as well as the reflection density of the background moved away from the developing roller 12 (labeled Background 1 in (f) of FIG. 6). The main controller 29 determines, based on the ratio between the two output voltages, whether or not toner should be replenished to the casing 11 of the developing device 10. If toner is necessary, then the main controller 29 causes the toner replenishing roller 30, FIG. 1, to rotate.

While the toner pattern is brought to the transfer roller 13, the voltage of the same polarity (second polarity) as the charge of the toner is applied to the transfer roller 13. After the toner pattern has moved away from the transfer roller 13, the voltage of second polarity is continuously applied over at least one rotation of the roller 13, i.e., during the cleaning time t. As a result, the surface of the transfer roller 13 is cleaned.

Figure 7:
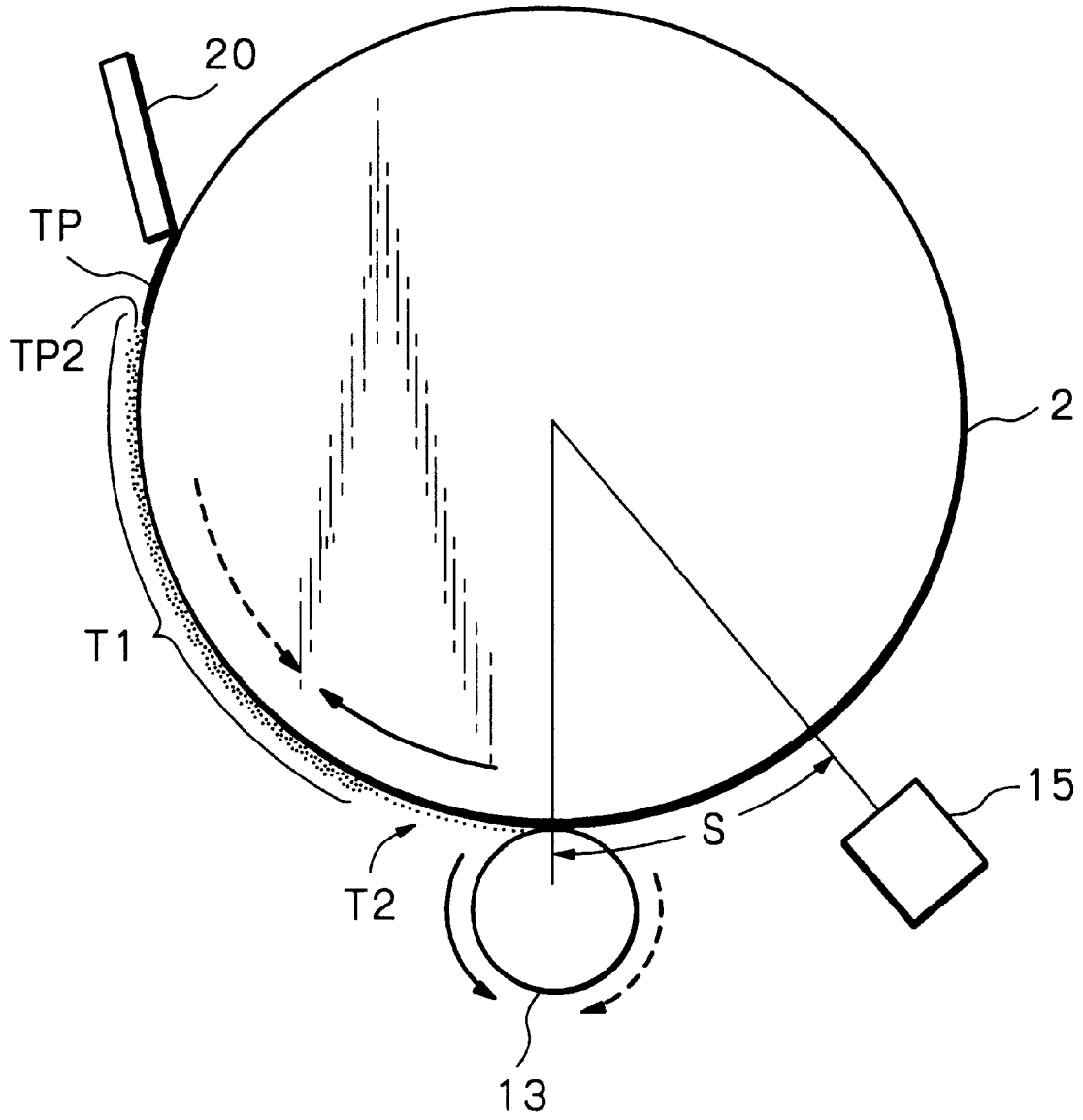
FIG. 7 shows how a photoconductive element included in the illustrative embodiment is rotated in the reverse direction.

FIG. 7 shows a condition in which the drum 2 has been rotated by a small additional angle after the above cleaning operation. As shown, toner T1 returned from the transfer roller 13 to the drum 1 during the cleaning time t is present on the drum 2 upstream of the trailing edge TP 2 of the toner pattern TP in the direction of rotation of the drum 2. If the surface of the transfer roller 13 is deteriorated, then it cannot be fully cleaned during the cleaning time t. As a result, toner T2 returned from the transfer roller 13 to the drum 2 after the cleaning time t is present on the drum 2 upstream of the toner T1 in the direction of rotation of the drum 2. If the surface of the transfer roller 13 is free from deterioration, then the transfer roller 13 can be fully cleaned within the cleaning time t, so that the toner T2 will be absent or negligible in amount.

Figure 8:
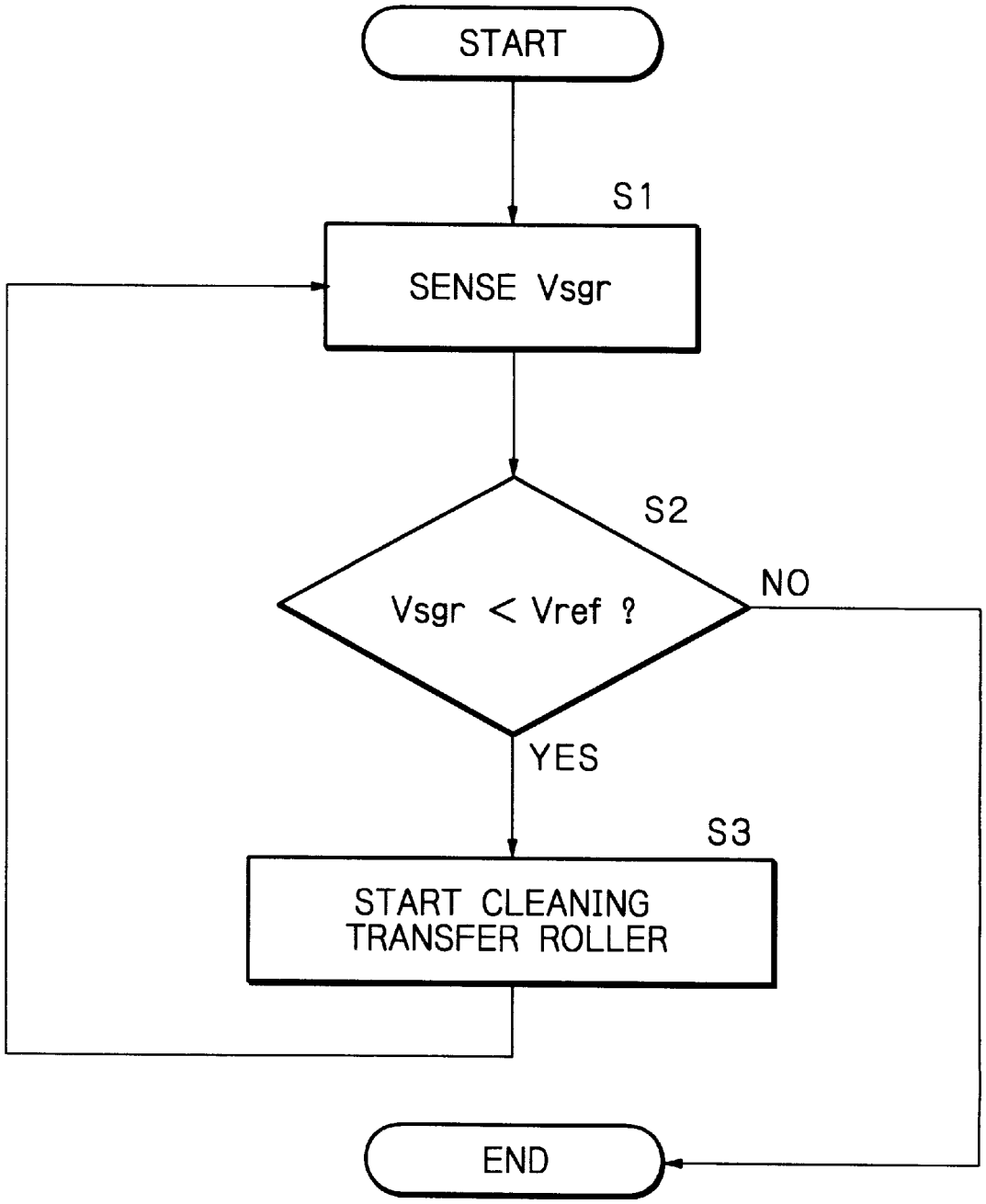
FIG. 8 is a flowchart demonstrating a specific operation of the illustrative embodiment for again cleaning a transfer roller included in the illustrative embodiment.

On the elapse of the cleaning time t, the rotation of the drum 2 is interrupted, and then the rotation of the drive motor is reversed in order to rotate the drum 2 in the reverse direction, as indicated by a phantom arrow in FIG. 7 (labeled Reverse in FIG. 6). When the portion of the drum 2 where the toner T2 is present faces the sensor 15, i.e., arrives at a sensing position, the sensor 15 again senses the reflection density of the above portion of the drum 2 (labeled Background 2 in FIG. 6). Assume that at this time the sensor 15 outputs a voltage Vsgr. Then, as shown in FIG. 8, the voltage Vsgr is detected (step S1, FIG. 8). The voltage Vsgr is low if the amount of toner T2 is great or high if it is small or zero.

The main controller 29, FIG. 5, compares the output voltage Vsgr of the sensor 15 with a reference voltage Vref (step S2, FIG. 8). If the voltage Vsgr is higher than the reference voltage V, then the main controller 29 determines that the toner T2 on the drum 2 is absent or negligible in amount, and does not execute the cleaning of the transfer roller 3.

If the voltage Vsgr is lower than the reference voltage Vref, the main controller 29 determines that the amount of toner T2 returned to the drum 2 is greater than a reference amount, i.e., that the transfer roller 13 is deteriorated too much to be fully cleaned within the cleaning time t. In this case, the main controller 29 causes each of the drum 2 and transfer roller 13 to rotate in a direction indicated by a solid arrow in FIGS. 1 and 7, until the roller 13 completes at least one rotation. During this period of time, the main controller 29 causes the power source 34 to apply the voltage of second polarity (identical with the polarity of the toner) to the transfer roller 13, thereby cleaning the transfer roller 13 (step S3, FIG. 8). After this cleaning step, the main controller 29 again causes the drum 2 and transfer roller 13 to rotate in the directions indicated by phantom arrows so as to detect the voltage Vsgr (step S1, FIG. 8). In this manner, the transfer roller 13 is repeatedly cleaned until the voltage Vsgr exceeds the reference voltage Vref. When the voltage Vsgr exceeds the reference voltage Vref, the main controller 29 determines that no toner will be returned from the transfer roller 13 to the drum 2, and ends the cleaning procedure.

To determine the condition of the toner T2 at the time of the second detection, it is necessary to rotate the drum 2 in the reverse direction for more than a period of time in which the portion where the drum 2 and transfer roller 13 have contacted at the beginning of the reverse rotation of the drum 2 reaches the sensing range of the sensor 15. Specifically, as shown in FIG. 7, assume that the sensing position assigned to the sensor 15 and the transfer region of the drum 2 which the transfer roller 13 has contacted are spaced by a distance S along the circumference of the drum 2, that the surface of the drum 2 moves at a linear velocity Vp, and that the sensor 15 needs a minimum reading time $\alpha$. Then, the drive motor and drum 2 are reversed for more than a period of time expressed as $(S/Vp+\alpha)$.

As stated above, in the third construction, the above sensing position where the density sensing means senses the surface of the image carrier is positioned downstream of the developing region assigned to the developing device 10, but upstream of the transfer region assigned to the transfer member, in the direction of rotation of the image carrier. After the stop of application of the voltage of second polarity to the transfer member, drive control means reverses the rotation of the image carrier such that the density sensing means again senses the deposition of toner returned from the transfer member. Let this construction be referred to as a fourth construction.

In the fourth construction, the procedure shown in FIG. 8 is such that when the density sensing means determines that the amount of toner deposited on the image carrier is greater than a reference amount, the transfer member is caused to make at least one additional rotation while the voltage applying means is caused to apply the voltage of second polarity to the transfer member. Let this construction be referred to as a fifth construction.

When the amount of toner T2 returned from the transfer roller 13 to the drum 2 is particularly great, the voltage to be applied to the transfer roller 13 for the second cleaning step may be raised in order to further enhance efficient cleaning, as follows. When the amount of toner T2 deposited on the drum 2 is above a first reference amount, but below a second reference amount, a first voltage of second polarity is applied to the transfer roller 13 in order to clean the roller 13. This is identical with the procedure of FIG. 8. On the other hand, when the amount of toner T2 is above the second reference amount greater than the first reference amount, a second voltage higher in absolute value than the first voltage is applied to the transfer roller 13 at the time of the second cleaning for thereby enhancing the cleaning efficiency.

Figure 9:
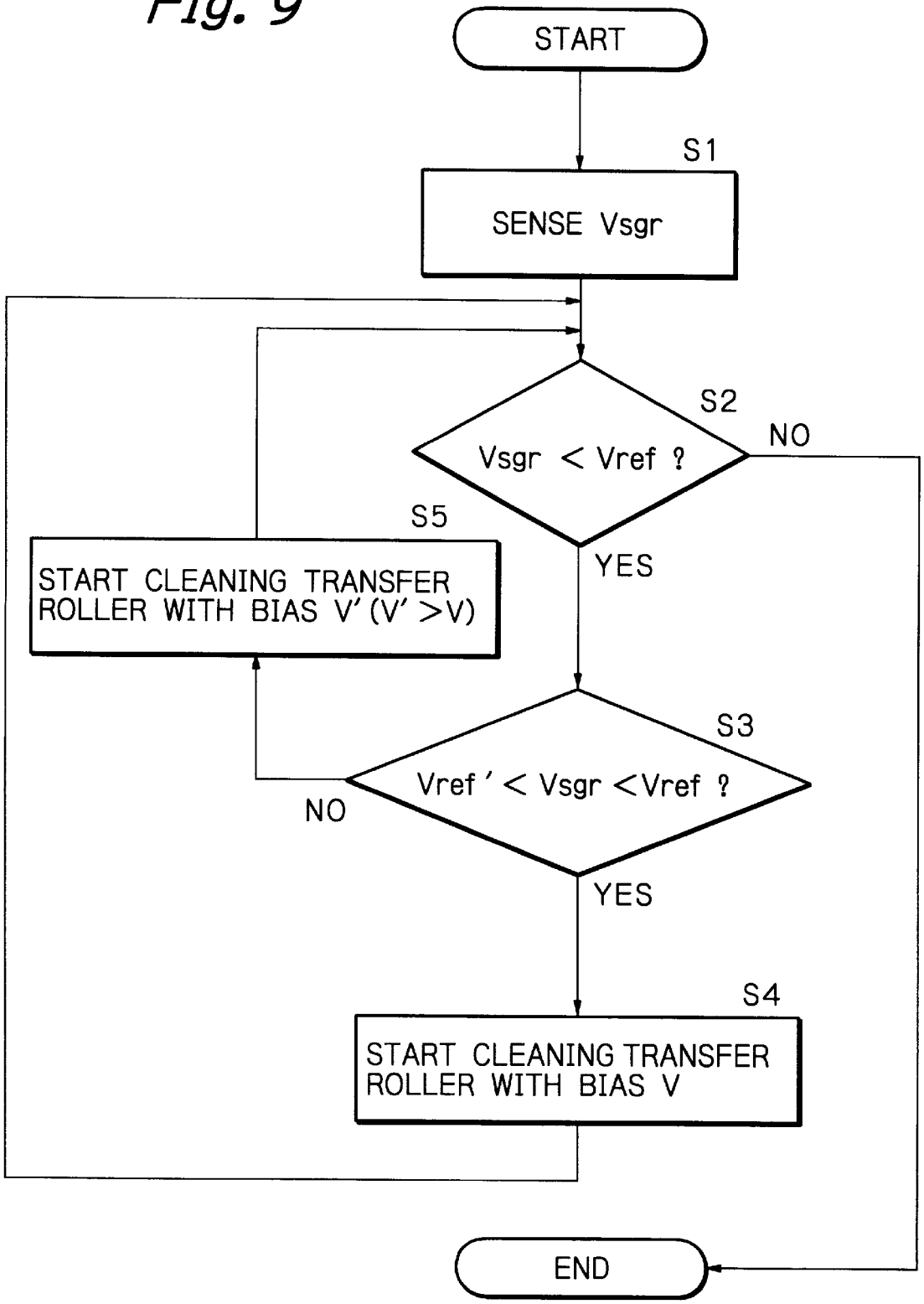
FIG. 9 is a flowchart showing another specific operation for again cleaning the transfer roller.

FIG. 9 shows a specific procedure for implementing the above scheme. As shown, after the first cleaning of the transfer roller 13, the drum 2 and roller 13 are reversed, as indicated by the phantom arrows in FIG. 7, and the sensor 15 senses the reflection density of the portion of the drum 2 where the toner T2 is present, in exactly the same manner as in FIG. 8 (step S1). The resulting output voltage Vsgr of the sensor 15 is compared with the reference value Vref (step S2). If the voltage Vsgr is lower than the voltage Vref, then the amount of toner T2 is determined to be greater than a first reference amount. In this case, the voltage Vsgr is compared with a second reference value Vref' smaller than the first reference value Vref (step S3).

If the voltage Vsgr is smaller than the reference value Vref, but greater than the reference value Vref', then the drum 2 and transfer roller are rotated in the directions indicated by solid arrows in FIG. 7. During at least one rotation of the transfer roller 13, the power source 34 applies a first voltage V of second polarity to the transfer roller (step S4).

If the voltage Vsgr is smaller than the second reference value Vref', then the amount of toner T2 is determined to be greater than a second reference amount greater than the first reference amount, i.e., to be extremely great. In this case, the drum 2 and transfer roller 13 are rotated in the directions indicated by solid arrows in FIG. 7. While the transfer roller 13 makes at least one rotation, a second voltage V' of second polarity is applied to the roller 13 (step S5). The second voltage V' is greater in absolute value than the first voltage V, so that the toner on the transfer roller 13 is returned to the drum 2 by a more intense electrostatic force.

The above sequence of steps are repeated until the voltage Vsgr exceeds the first reference value Vref. In this manner, even when the transfer roller 13 is noticeably deteriorated, its surface can be surely cleaned so as to prevent the toner from depositing on a paper.

As stated above, in the fourth construction, the above density sensing means determines whether or not the amount of toner deposited on the image carrier is greater than the first reference value, but smaller than the second reference value greater than the first reference value. If the answer of this decision is positive, then the transfer member is caused to make at least one additional rotation while the first voltage V of second polarity is applied from the voltage applying means to the transfer member. If the amount of toner on the image carrier is greater than the second reference amount, then the transfer member is caused to make at least one additional rotation while the second voltage V' of second polarity and greater in absolute value than the first voltage V is applied to the transfer member. Let this construction be referred to as a All sixth construction.

In the specific procedures shown in FIGS. 2 and 6, the negative voltage is applied to the transfer roller 13 before the leading edge of the toner pattern reaches the roller 13. This successfully reduces the deposition of toner on the transfer roller 13. If the negative voltage begins to be applied to the transfer roller 13 when the leading edge of the toner pattern reaches the roller 13, then it is likely that the toner on the drum 2 is transferred to the transfer roller 13 in a great amount due to a slight error in timing. The above scheme obviates such an occurrence also.

As stated above, in the first to sixth constructions, the above voltage applying means starts applying the voltage of second polarity to the transfer member before the leading edge of the toner pattern carried on the image carrier reaches the transfer member. Let this construction be referred to as a seventh construction.

It is to be noted that the toner moved away from the transfer roller 13 without depositing it and the toner returned from the roller 13 to the drum 2 are, of course, removed from the drum 2 by the cleaning member 20 of the cleaning device 19. In this manner, despite that the transfer roller 13 is not released from the drum 2, there can be obviated an occurrence that a great amount of toner is transferred from the drum 2 to the transfer roller 13 and smears the rear of the paper P.

In the specific procedure shown in FIGS. 2 and 3, the toner pattern is formed on the drum 2 at the time of warm-up preceding the actual formation of a toner image on the drum 2. When the image density of the toner pattern is lower than a preselected value, toner replenishment to the developing device 10 is effected prior to the formation of a toner image. Therefore, at the time when a toner image begins to be formed, the developer D in the developing device 10 has already been provided with a toner content lying in the adequate range. It follows that a toner image can be formed with stable image density from the beginning. Moreover, the formation of the toner pattern and toner replenishment are effected during warm-up time necessary for, e.g., the heat roller 17 to be heated. The procedure therefore does not wastefully increase the overall image forming time.

As stated above, in the first to seventh constructions, the above latent image forming means and developing device 10 operable with the two-ingredient type developer form the toner pattern on the image carrier during warm-up preceding the formation of a toner image. When the density of the toner pattern is lower than a preselected value, as determined by the density sensing means including the sensor 15, the toner replenishing means replenishes toner to the developing device 10 prior to the formation of a toner image. Let this construction be referred to as an eighth construction. In the eighth construction, the toner container 31, toner replenishing motor controlled by the main controller 29, and toner replenishing roller 30 driven by the motor constitute the toner replenishing means.

The transfer roller 13 continuously contacts the drum 2 either directly or with the intermediary of the paper P so long as the drum 2 is in rotation. When the paper P jams a paper transport path, the transfer roller 13 can be released from the drum 2 by hand in order to remove the jamming paper P.

When the developer D has an adequate toner content, the density of the toner pattern may be suitably adjusted by adjusting the surface potential of the latent image expected to turn out the toner pattern. However, should the density of the toner pattern selected be excessively high, a greater amount of toner would deposit on the transfer roller and undesirably increase the cleaning time t.

FIG. 10 shows a specific relation between the image density ID of the toner pattern and the required cleaning time t (second). As shown, the cleaning time t decreases with a decrease in the image density ID and reduces the amount of toner to deposit on the transfer roller 13, so that the life of the roller 13 is extended. By contrast, when the image density ID is excessively low, the sensing accuracy of the sensor 15 decreases. Therefore, the image density ID should not be reduced to an excessive degree. It is preferable that the image density ID be not excessively reduced, and in addition the cleaning time t be as short as possible.

Further, in the illustrative embodiment, the image density of the toner pattern is so controlled as to make the cleaning time t shorter than the warm-up time in which the heat roller 17 reaches its adequate temperature. With this scheme, it is possible to clean the transfer roller 13 within a preselected period of time without the cleaning time t being noticeably varied.

In any one of the foregoing constructions, when the density of the toner pattern is determined to be lower than the preselected value, the toner T is replenished into the developer D. At this instant, it is likely that the toner T is replenished more than necessary. This would increase the density of a toner image to an unusual degree and lower image quality.

In the above description, the low density of the toner pattern is assumed to indicate that the toner content of the developer D in the casing 11 is low. However, the low density of the toner pattern may indicates, in addition to the low toner content of the developer D, that the amount of toner T remaining in the toner container 31 is small or zero. In the former case, it suffices to replenish toner T to the developer D by the previously stated replenishing operation. In the latter case, however, despite the toner replenishing operation, the toner content of the developer D does not increase; the operator must replenish toner to the toner container 31.

In light of the above, in the eighth construction, the following arrangement should advantageously be made. when the density of the toner pattern is lower than the preselected value, as determined by the density sensing means including the sensor 15, at least one additional toner pattern is formed on the image carrier before the formation of a toner image. If the density of the additional toner pattern is also determined to be low, the toner replenishing means replenishes toner to the developing device 10 before the formation of a toner image. When the additional toner pattern is brought to the transfer member contacting the image carrier, the voltage applying means again applies the voltage of second polarity to the transfer member. Let this construction be referred to as a ninth construction.

In accordance with the ninth construction, when the density of the first toner pattern is low, the toner replenishing operation is executed while the second toner pattern is formed on the drum 2. If the density of the second toner pattern is also low, toner is replenished to the developing device 10. Toner is therefore replenished to the developing device 10 only in a necessary amount at a time. This prevents the toner from being replenished in an excessive amount at a time and thereby ensures a toner image with stable density from the beginning.

In the ninth construction, an arrangement may advantageously be made such that if the density of the additional toner pattern is low even after a plurality of times of toner replenishment, control means determines that toner must be replenished into a toner replenishing section (toner container 31, FIG. 1). This control means may also be implemented by the main controller 29 shown in FIG. 5. Let this construction be referred to as a tenth construction.

With the tenth construction, it is possible to determine, before the formation of a toner image, whether toner should be simply replenished to the developing device 10 or whether the operator should replenish toner to the toner container 31. The tenth construction therefore ensures a high quality toner image at all times.

Figure 11A:
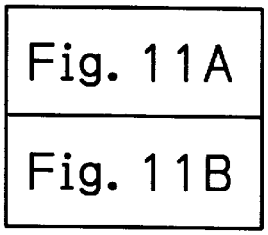
FIG. 11 is a flowchart showing another specific operation of the illustrative embodiment.
Figure 11A:
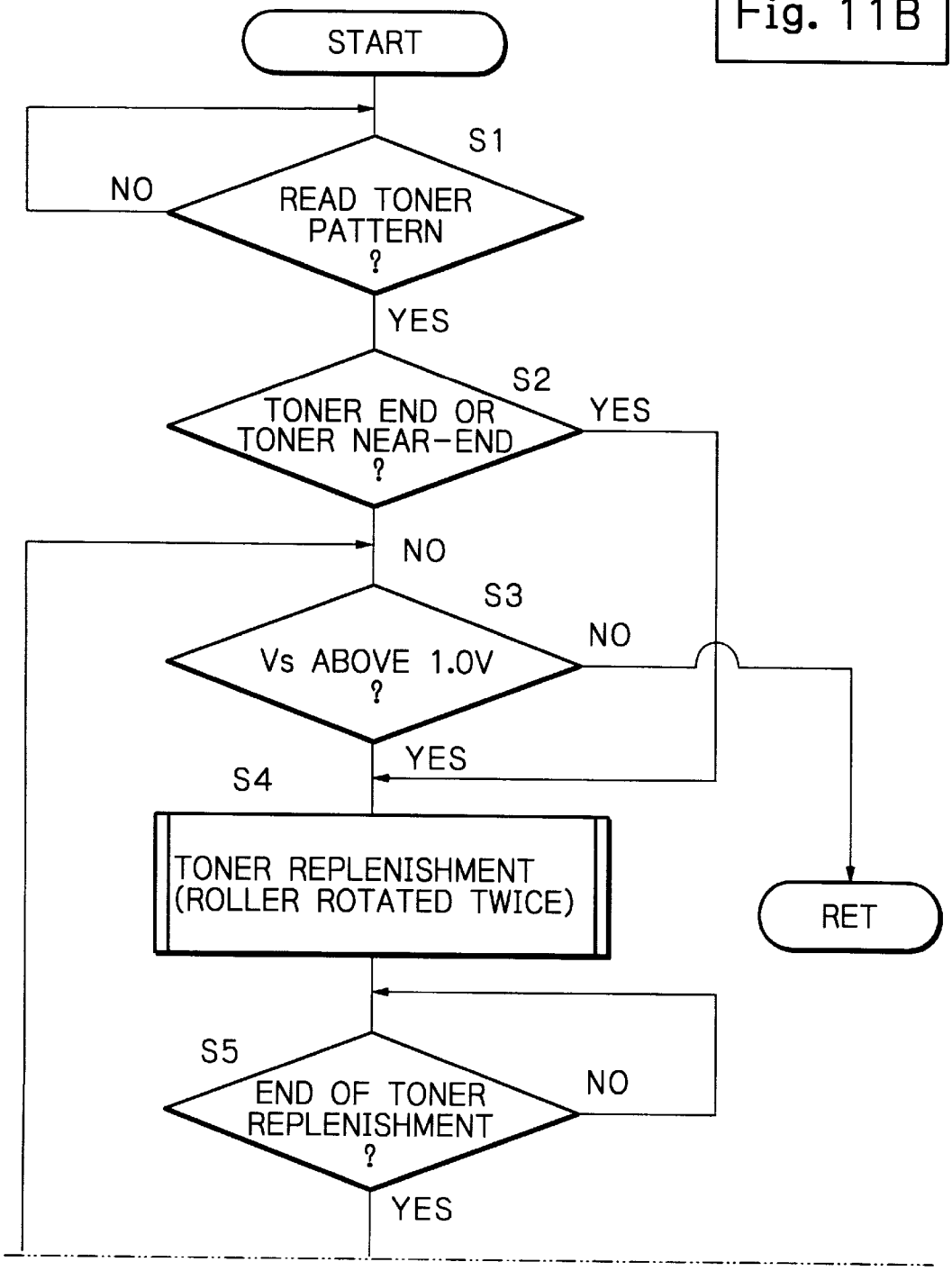
Figure 11B:
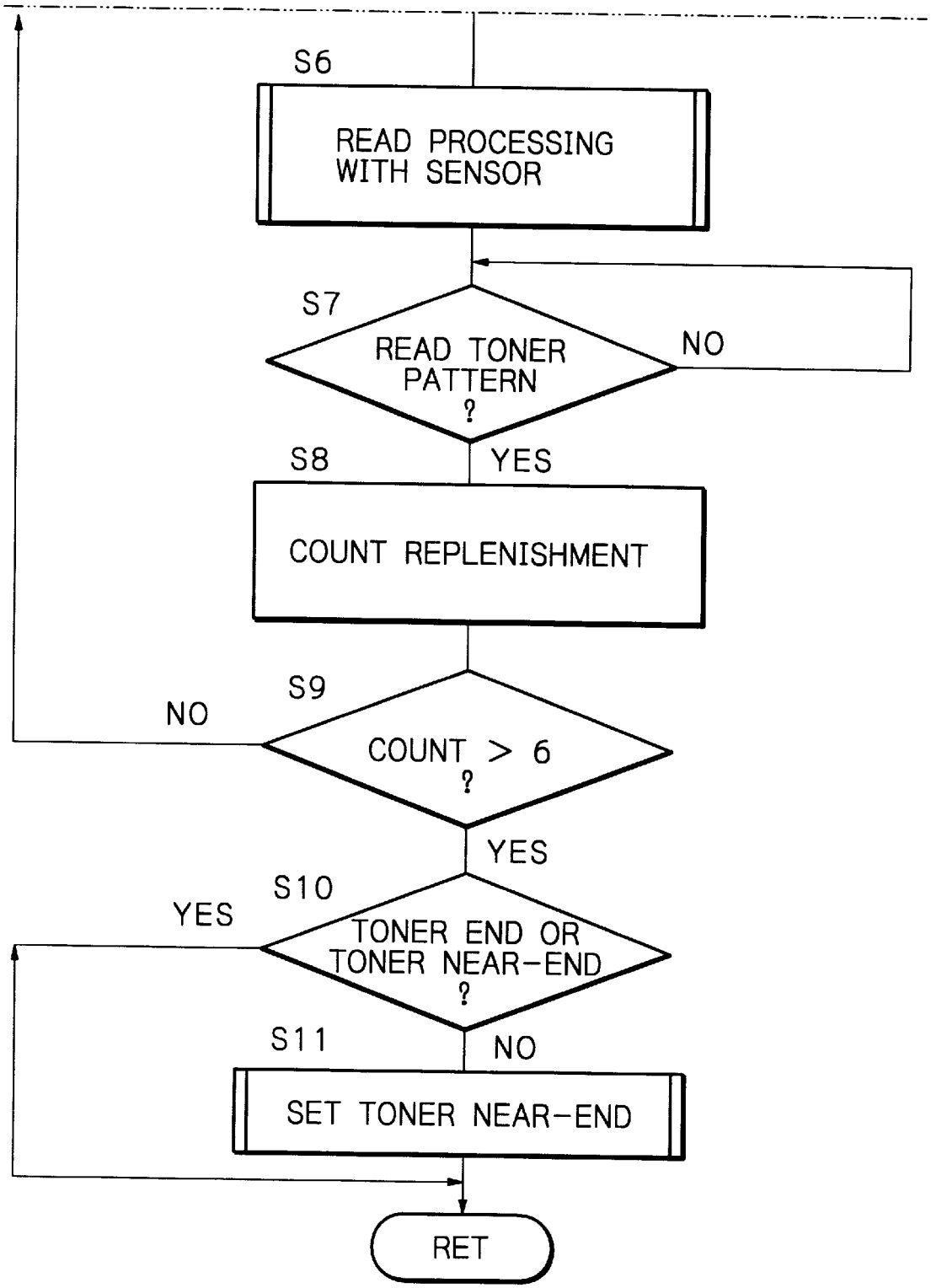

FIG. 11 demonstrates the procedures particular to the ninth and tenth constructions more specifically. As shown, the main controller 29 determines whether or not the first toner pattern has been read (step S1). The step S1 is identical with the step S1 of FIG. 3. Subsequently, the main controller 29 determines whether or not the apparatus has reached a toner near-end condition or a toner end condition (step S2). The toner near-end condition is such that the amount of toner T remaining in the toner container 31, FIG. 1 is so small, it will become zero if the image forming operation is continued. The toner end condition is such that the toner container 31 has run out of toner. If the apparatus is in neither one of the toner near-end and toner end conditions, then the main controller 29 determines whether or not the output voltage Vsp of the sensor 15 read the above toner pattern is higher than 1.0 V (step S3).

If the voltage Vsp is lower than 1.0 V, then the main controller 29 determines that the density of the toner pattern and therefore the toner content of the developer D is sufficiently high. In this case, the main controller 29 does not execute toner replenishment, but executes the formation of a toner image after the heat roller 17 has reaches its preselected temperature. If the voltage Vsp is higher than 1.0 V, if the density of the toner pattern, i.e., the toner content of the developer D is lower than the preselected value, and if the apparatus is in the toner near-end or toner end condition (step S2), then the main controller 29 causes the toner replenishing roller 30 to rotate for replenishing toner to the developing device 10 (step S34). In this case, too, the roller 30 should preferably be rotated a plurality of times, e.g., twice for the previously stated reason.

After the toner replenishment (step S5), the main controller 29 causes, before a toner image is formed on the drum 2, an additional toner pattern to be formed on the drum 2 under the same conditions as the first toner pattern, and then causes the sensor 15 to read the additional toner pattern (step S6). After the sensor 15 has read the additional toner pattern (step S7), the main controller 29 determines how many times the toner replenishing operation has been repeated (step S8). Then, the main controller 29 determines whether or not the toner replenishing operation has been repeated more than a preselected number of times, e.g., six times (step S9). If the answer of the step S9 is negative, then the main controller 29 determines the density of the additional toner pattern (step S3). If the resulting output voltage Vsp of the sensor 15 is lower than 1.0 V, then the main controller 29 executes the formation of a toner image only if the heat roller 17 has reaches the preselected temperature. If the voltage Vsp is lower than 1.0 and if the apparatus is in the toner end or toner near-end condition, then the main controller 29 clears the toner end or toner near-end condition.

Again, if the above voltage Vsp is higher than 1.0 V, the main controller 29' repeats the toner replenishment to the developing device 10 before the formation of a toner image (step S4). This is followed by the steps S5–S9. When the toner replenishment is repeated six times or more, the main controller 29 determines whether or not the apparatus is in the toner end or toner near-end condition (step S10). If the apparatus is in neither one of the two end and toner near-end conditions, the main controller 29 writes the toner end condition in a nonvolatile RAM (Random Access Memory) and thereby sets such a condition (step S11). In this manner, the fact that the operator must replenish toner to the toner container is detected and displayed on a display mounted on the apparatus body, urging the operator to replenish to the toner container 31. When a toner image is formed a preselected number of times after the toner near-end condition has been set, the toner end condition is set and usually inhibits a toner image from being formed.

Of course, even when the additional toner pattern is brought to the transfer roller 13 contacting the drum 2, the voltage of the same polarity as the toner forming the toner pattern is applied to the transfer roller 13. This reduces the deposition of the toner on the transfer roller 13, and in addition causes the toner deposited on the transfer roller 13 to be removed. Also, the toner of the consecutive toner patterns are finally collected in the cleaning device 10.

As stated above, when the density of the first toner pattern is determined to be low, toner is replenished to the developing device 10. Subsequently, at least one additional toner pattern is formed on the drum 2. If the density of the additional toner pattern is also determined to be low, toner is again replenished to the developing device 10 before the formation of a toner image. Consequently, toner is prevented from being replenished to the developing device 10 in an excessive amount.

When the density of the additional toner pattern does not increase despite a plurality of times of toner replenishment, it is determined that toner must be replenished to the toner replenishing section as distinguished from the developing device 10. In this specific procedure, the processing executed over a period of time T1 (dash-and-dot line) is repeated a preselected number of times until the output voltage Vsp of the sensor 15 drops below 1.0 V. When the voltage Vsp drops below 1.0 V, the toner end and toner near-end conditions are cleared, as stated earlier. If the voltage Vsp does not drop below 1.0 V, then the toner near-end condition is set (step S11, FIG. 11). This toner near-end condition or the next toner near-end condition is written to the RAM, so that toner will be replenished without fail at the time of power-on (step S4). For example, toner is replenished to the toner container 31 when the apparatus is out of operation, the toner end or toner near-end condition is cancelled by the above procedure. FIG. 11 is identical with FIG. 4 as to the basic operation timings.

Assume that the toner pattern is formed during the warm-up time necessary for the heat roller 17 to reach the preselected temperature after the power-up of the apparatus, and then the density of the image is determined. Then, the toner pattern may be formed after every power-up. This, however, increases the number of toner patterns to be formed and is apt to aggravate the adhesion of toner to the transfer roller 13. As a result, the transfer roller 13 is likely to wear rapildy.

Further, assume that the power switch of the apparatus is turned off and again turned on in a short period of time. Then, the heat roller 17 is held at a comparatively high temperature and and will reach the preselected temperature soon. In this condition, forming the toner pattern during warm-up time after the power-up is undesirable for the following reason. Because the warm-up time is short, the negative voltage identical in polarity with the toner must be continuously applied to the transfer roller 13 for cleaning it even after the heat roller 17 has reached the preselected temperature. As a result, the waiting time up to the beginning of formation of a toner image on the drum 2 is extended more than necessary.

Figure 12:
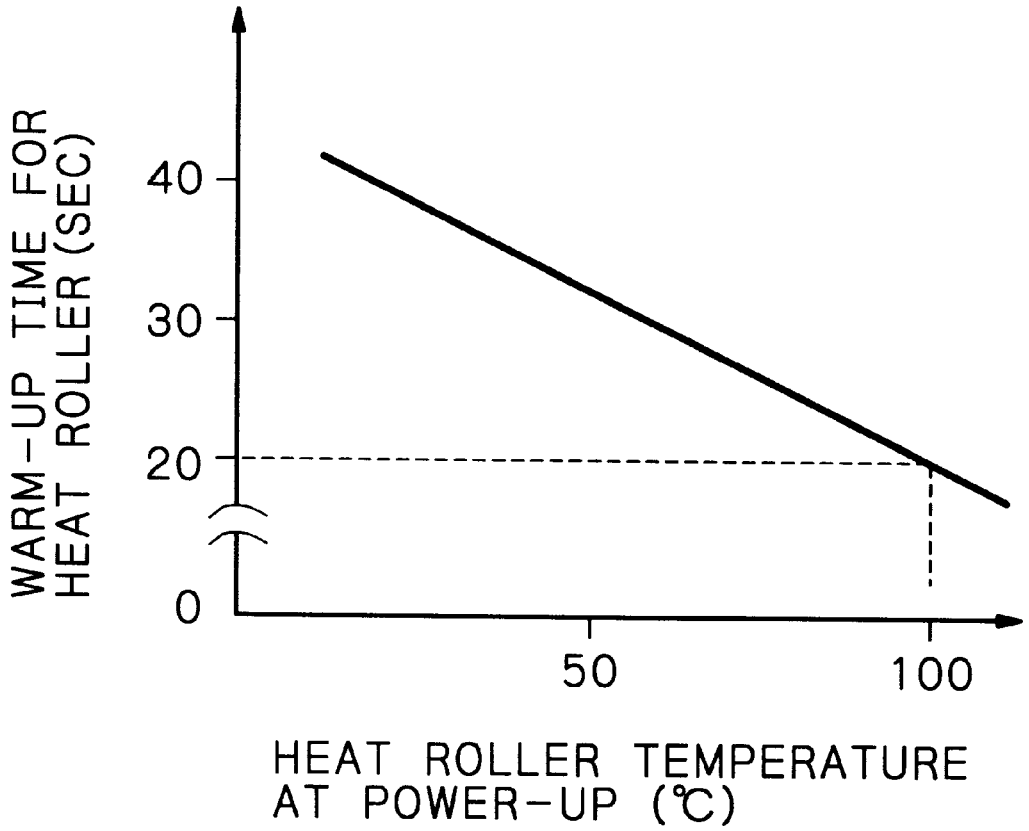
FIG. 12 a graph showing a specific relation between the temperature of a heat roller at the time of power-up of the apparatus and the period of time necessary for the heat roller to reach a temperature suitable for the fixation of a toner image.

Specifically, assume that the temperature of the heat roller 17 suitable for the fixation of a toner image is 180° C., as mentioned earlier, and that use is made of a 500 W to 800 W halogen heater. Then, the temperature of the heat roller 17 at the time of power-up of the apparatus and the time necessary for the heat roller 17 to reach 180° C. have a specific relation shown in FIG. 12. As shown, when the heat roller 17 is held at 100° C. at the time of power-up of the apparatus, the roller 17 reaches 180° C. in 20 seconds since the power-up. If the toner pattern is formed on the drum 2 even in such a condition, then the transfer roller 13 must be continuously cleaned even after the heat roller 17 has reached 180° C., causing the operator to wait more than a necessary period of time.

To solve the above problem, only when the operation for forming a toner image is repeated more than a preselected number of times, e.g., 100 times and if the temperature of the heat roller 17 at the time of power-up is lower than a preselected temperature, e.g., 80° C., the illustrative embodiment forms the toner pattern on the drum 2. For this purpose, the illustrative embodiment includes counting means including a counter for counting consecutive image forming operations (copies). The count of the counter is written to the RAM of the main controller 29, FIG. 5. Further, at the time of power-up of the apparatus, the temperature sensing means including the thermistor 23 senses the temperature of the heat roller 17. If the temperature of the heat roller 17 is lower than the preselected temperature, the toner pattern is formed on the image carrier before the formation of a toner image. This kind of arrangement will be described more specifically hereinafter.

The thermistor 23 and main controller 29 and a heat roller controller 36 also shown in FIG. 5 constitute the temperature sensing means responsive to the temperature of the heat roller 17. The heat roller controller 36 selectively turns on or turns off the heater 2 of the heat roller 17 in accordance with the output signal of the thermistor 23 and information received from the main controller 29. Also, the controller 36 sends information representative of the temperature of the heat roller 17 and output from the thermistor 23 to the main controller 29. In response, the main controller 29 executes a sequence of steps shown in FIG. 13.

Figure 13:
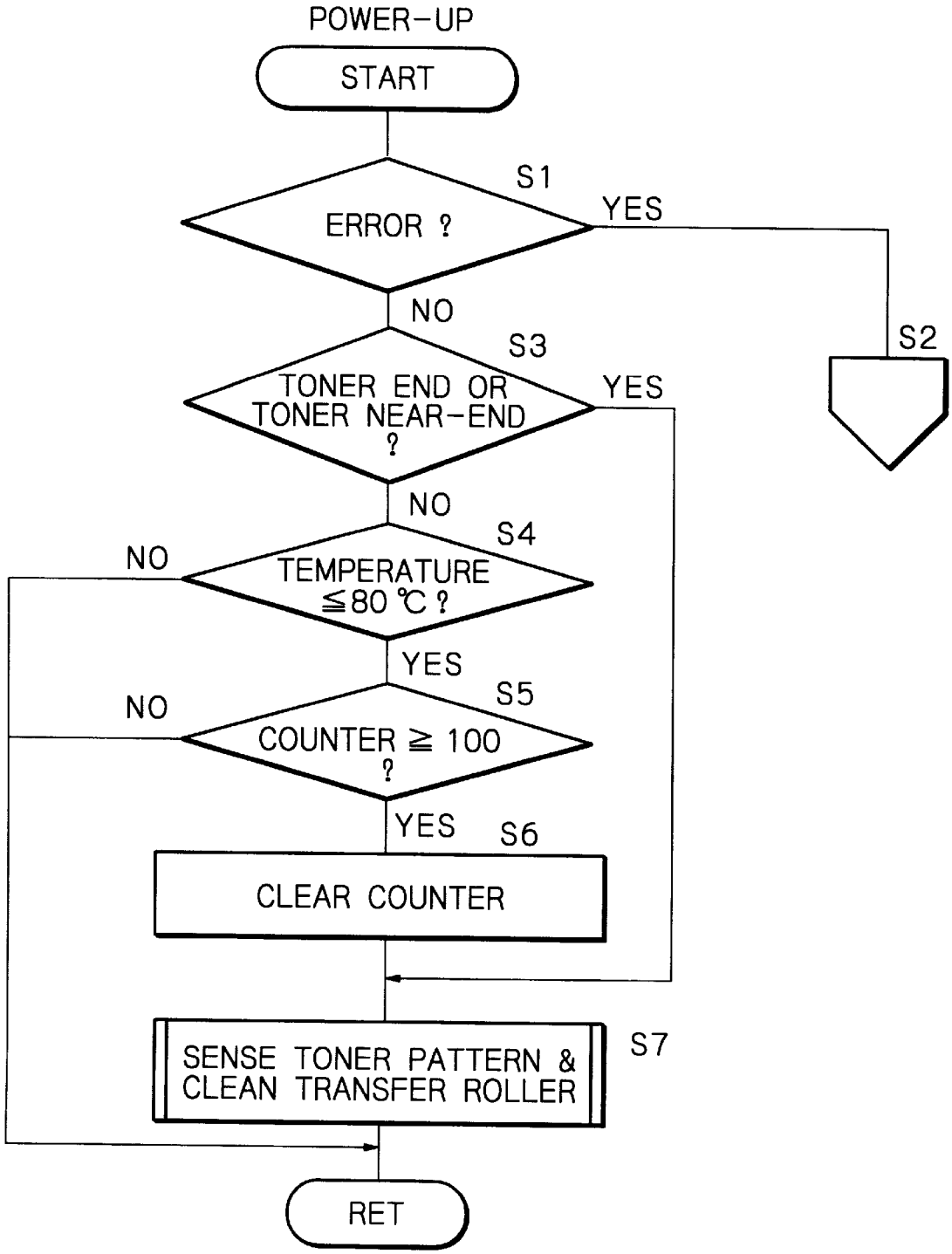
FIG. 13 is a flow chart showing another specific operation of the illustrative embodiment.

As shown in FIG. 13, at the time of power-up of the apparatus, the main controller 29 determines whether or not the opening of a front door, not shown, or similar error has occurred (step S1). If such an error has occurred, then the main controller 29 executes an error processing routine (S2). If the apparatus is free from errors, then the main controller 29 determines whether or not the apparatus is in the toner end or toner near-end condition (step S3). If the answer of the step S3 is negative, then the main controller 29 determines the temperature of the heat roller 17 on the basis of the output signal of the thermistor 23 (step S4). If the temperature of the heat roller 17 is higher than 80° C., then the main controller 29 allows the toller 17 to be heated to 180° C. without forming any toner pattern.

If the temperature of the heat roller 17 is lower than 80° C., as determined in the step S4, then the main controller 29 checks the counter to see if the toner image forming operation (copies) has been repeated more than 100 times or not (step S5). If the answer of the step S5 is negative, then the main controller 29 does not form any toner pattern. If the answer of the step S5 is positive, then the main controller 29 clears the counter (step S6), forms the toner pattern on the drum 2, causes the sensor 15 to sense the density of the toner pattern, and causes the negative voltage to be applied to the transfer roller 13 for cleaning the roller 13 (step S7). If the density of the toner pattern is low, then the main controller 29 executes toner replenishment to the developing device 10 with any one of the previously stated schemes.

As stated above, in the eighth to tenth constructions, the above procedure uses the heat roller 17 and the temperature sensing means responsive to the temperature of the heat roller 17. The latent image forming means and developing device 10 are constructed to form the toner pattern on the drum 2 only when the temperature sensing means determines that the temperature of the heat roller 17 is lower than the preselected temperature. Let this construction be referred to as an eleventh construction.

Likewise, in the first to eleventh constructions, the counting means for counting consecutive toner image forming operations (copies) is used. The latent image forming means and developing device 10 are constructed to form the toner pattern when the counting means determines that the toner image forming operation has been repeated the preselected number of times. Let this construction be referred to as a twelfth construction.

Further, in the first to tenth constructions, the above specific procedure uses the counting means, heat roller 17, and temperature sensing means responsive to the temperature of the heat roller 17. The latent image forming means and developing device 10 are constructed to form the toner pattern on the drum 2 before the formation of a toner image if the toner image forming operation has been repeated the preselected number of times and if the temperature of the heat roller 17 at the time of power-up of the apparatus is lower than the preselected temperature. Let this construction be referred to as a thirteenth construction.

The foregoing constructions each forms the toner pattern when the image forming operation is repeated the preselected number of times (100 times in the embodiment). This successfully reduces the number of toner patterns to be formed and thereby obviates the adhesion of toner to the transfer roller 13 which would reduce the life of the roller 13. Further, the toner pattern is formed only if the temperature of the heat roller 17 is lower than the preselected temperature (80° C. in the embodiment). It follows that the formation of the toner pattern, the sensing of the image density and the cleaning of the transfer roller 13 can be completed before the heat roller 17 is heated to the preselected temperature (180° C. in the embodiment), reducing the waiting time up to the formation of a toner image.

As FIG. 13 indicates, when the toner end or toner near-end condition is set, the toner pattern is formed at each time of power-up. If the density of the toner pattern is low, then toner is replenished to the developing device 10. That is, in the thirteenth construction, when toner should be replenished to the toner replenishing device (toner container 31, FIG. 1), the latent image forming means and developing apparatus 10 form the toner pattern on the drum 2 without regard to the temperature of the heat roller 17 or the number of times of image forming operation. Let this construction be referred to as a fourteenth construction. With the fourteenth construction, it is possible to form a toner image with preselected density from the beginning.

In the above specific constructions, the density of the toner pattern is sensed for the purpose of controlling the toner content of the developer D stored in the developing device 10. The density of the toner pattern may be used for any other purpose. For example, an arrangement may be made such that a first toner pattern and a second toner pattern lower in density than the first toner pattern are sequentially formed on the drum 2 at circumferentially spaced locations and have their densities sensed by the sensor 15. The resulting outputs of the sensor 15 indicate the degree of contamination of the background. In this case, the bias voltage for the developing roller 12 may be corrected on the basis of the contamination of the background in order to reduce the contamination.

Specifically, when the first toner pattern is formed, the drum 2 is charged to −850 V by the charger roller 3 while the surface potential of a latent image representative of the pattern is controlled to −200 V, as stated earlier. In addition, a bias voltage of −600 V is applied to the developing roller 12. The image forming potential is therefore 400 V. For the second toner pattern, the drum 2 is charged to, e.g., −850 V while the surface potential of the latent image is controlled to −200 V as for the first toner image. However, the bias voltage to be applied to the developing roller 12 is changed to −300 V, so that the image forming potential is 100 V.

The second toner pattern is lower in density than the first toner pattern. The density of the first toner pattern is used to control the toner content of the developer D. The densities of the first and second toner patterns are used to determine the degree of contamination of the background and correct, e.g., the voltage to be applied to the developing roller 12. In this case, when toner patterns are continuously formed on the drum 2 in the direction of rotation of the drum 2 without being noticeably spaced from each other in the circumferential direction, it is possible to prevent the density of the individual toner pattern from varying due to the change of image forming condition.

The amount of toner to deposit on the transfer roller 13 and therefore the cleaning time t increases with an increase in the density of the toner pattern. However, the density of the toner pattern should not be excessively reduced because an excessively low density would degrade the sensing accuracy of the sensor 15. It is therefore necessary to inhibit the density of the toner image from being reduced to an excessive degree, and in addition to reduce the cleaning time t as far as possible, as stated previously with reference to FIG. 10.

To meet the above requirement, the following conditions are desirable. The first toner pattern with high density is formed on the drum 2, and then the second toner pattern with low density is formed on the drum 2 upstream of the drum 2 in the direction of rotation of the drum 2. The voltage of the same polarity as the toner forming the toner patterns is continuously applied to the transfer roller 13 during the interval between the time when the leading edge of the first toner pattern reaches the roller 13 and the time when a preselected period of time elapses since the second toner pattern has moved away from the roller 13. This is also true when three or more toner patterns are sequentially formed on the drum 2 and have their densities sensed.

More generically, in the first to fourteenth constructions, the latent image forming means and developing device 10 sequentially form a plurality of toner patterns on the drum or image carrier 2 in the direction of movement of the surface of the drum 2, the toner pattern with the highest density being first. Let this construction be referred to as a fifteenth construction.

With the above construction, it is possible to assign a long cleaning time to the toner transferred from the toner pattern with high density to the transfer roller 13, in place of reducing the density of all of the toner patterns to an excessive degree. As a result, the overall cleaning time is reduced. Specifically, because the first toner pattern has high density, a great amount of toner is transferred from the toner pattern to the transfer roller 13. However, this toner is successfully returned to the drum 2 because a relatively long period of time is necessary for the last toner pattern to move away from the transfer roller 13. As for the last toner pattern with low density, the toner constituting it is transferred to the transfer roller 13 in an amount small enough to be rapidly returned to the drum 2.

When the toner constituting the toner pattern deposits, if a little, on the transfer roller 13, it adheres to the roller 13 little by little and causes the roller 13 to fatigue with the elapse of time. The fatigue of the transfer roller 13 directly translates into an increase in the period of time necessary for cleaning the roller 13. Therefore, if the cleaning time is unconditionally fixed, then it may occur that the heat roller 17 reaches its preselected temperature before the transfer roller 13 is fully cleaned, resulting in an increase in waiting time up to the formation of a toner image.

In light of the above, an arrangement should preferably be made such that when the formation of a toner image is repeated, e.g., 100,000 times, the density of the toner pattern is lowered in order to reduce the amount of toner to deposit on the transfer roller 13. This allows the transfer roller 13 to be fully cleaned within the preselected cleaning time t. Specifically, from the time when a new transfer roller 13 is used for the first time to the time when the formation of a toner image is repeated 100,000 times, the surface potential of a latent image representative of the toner pattern and the voltage to be applied to the developing roller are respectively controlled to −200 V and −600 V; the image forming potential is 400 V. After the 100,000 times of toner image formation, the surface potential of the latent image is switched to −300 V so as to implement an image forming potential of 300 V, thereby reducing the density of the toner pattern. If desired, the voltage to be applied to the developing roller 12 may be so varied as to reduce the density of the toner pattern. The processing with the output voltage of the sensor 15 is varied in accordance with the change in the voltage for the developing roller 12, so that the density of the resulting toner pattern can be accurately determined.

In the first to fifteenth constructions, the above construction reduces the density of the toner pattern on the basis of the number of times of toner image formation repeated and will be referred to as a sixteenth construction. This construction obviates the defective cleaning of the transfer roller 13 or the increase in waiting time despite the fatigue of the roller 13 ascribable to aging.

The density of the toner pattern sometimes rises or falls to an unusual degree when, e.g., the apparatus is used for the first time after a long term of stoppage or when the toner content of the developer D or the frictional charge deposited on the toner sharply varies. On the rise of the density, a great amount of toner deposits on the transfer roller 13 and cannot be removed within the cleaning time t. On the fall of the density, more than a necessary period of time is needed for the transfer roller 13 to be fully cleaned.

To solve the above problem, in the first to sixteenth constructions, when the density of the toner pattern is unusually high, as determined by the density sensing means, the voltage applying means increases the duration of the voltage of the same polarity as the toner and applied to the transfer member 13. Let this construction be referred to as a seventeenth construction. With this construction, it is possible to surely clean the transfer roller 13 even when the density of the toner pattern is unusually high.

Further, in the first to seventeenth constructions, when the density of the toner image is unusually high, as determined by the density sensing means, the voltage applying means should preferably be constructed to reduce the duration of the above voltage. Let this construction be referred to as an eighteenth construction. With this construction, it is possible to reduce the cleaning time to be assigned to the transfer roller 13 and therefore the fatigue of the roller 13.

Figure 14:
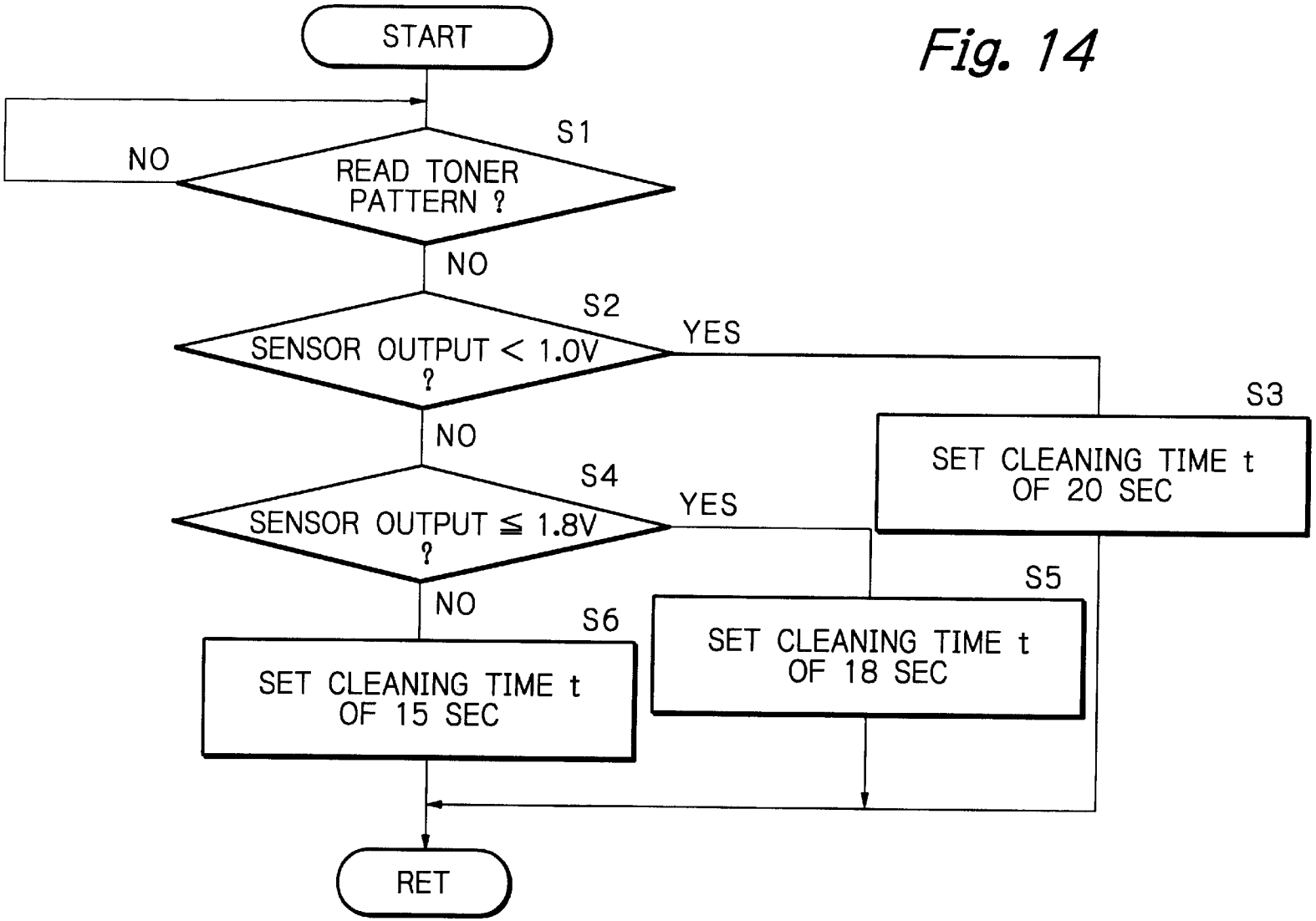
FIG. 14 is a flowchart showing a procedure for varying the cleaning time in accordance with the density of the toner pattern.

FIG. 14 shows a specific procedure associated with the seventeenth and eighteenth constructions. As shown, after the density of the toner pattern has been sensed (step S1), the main controller 29, FIG. 5, references the output voltage of the sensor 15 (step S2). If the output voltage is lower than 1.0 V, then the main controller 29 determines that the density of the toner pattern is unusually low, and sets a cleaning time t of 20 seconds (step S3). If the output voltage is higher than 1.0 V, but lower than 1.8 V inclusive (step S4), then the main controller 29 reduces the cleaning time t to 18 seconds (step S5). Further, if the output voltage is higher than 1.8 V, then the main controller 29 determines that the density of the toner pattern is unusually low, and further reduces the cleaning time t to 15 seconds (step S6).

In the illustrative embodiment, the output voltage V of the sensor 15 is assumed to be higher than 1.0 V, but lower than 1.8 V inclusive under usual conditions. In such a situation, the main controller 29 selects the cleaning time t of 18 seconds. The main controller 29 increases the cleaning time t to 20 seconds if the density is unusually high or reduces it to 15 seconds if the density is unusually low.

As stated above, the cleaning time t for cleaning the transfer roller 13 is switched in accordance with the condition of the apparatus. This obviates the defective cleaning of the transfer roller 13 and decelerates the fatigue of the transfer roller 13 ascribable to excessive rotation.

Figure 15:
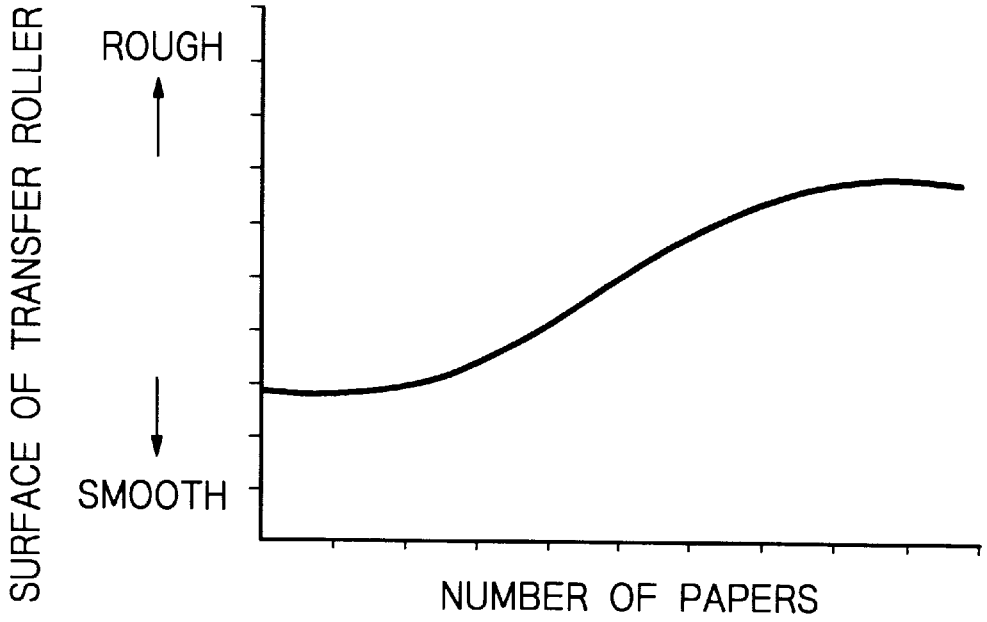
FIG. 15 is a graph indicating that the surface of the transfer roller becomes rough due to aging.

In any one of the foregoing constructions, the surface of the transfer roller 13 is initially smooth, as stated previously and as shown in FIG. 15. However, the surface becomes rough as the number of papers conveyed via the transfer roller 13, i.e., the period of time over which the roller 13 is used increases. Therefore, although the surface initially allows a minimum of toner to deposit thereon and is easy to clean, the toner transferred from the toner pattern on the drum 2 is more easily trapped on the surface as the time elapses and sequentially increases in amount. This makes it difficult for the surface to be cleaned. It is therefore preferable to increase, with the elapse of time, the duration of the negative voltage applied to the transfer roller 13 after the trailing edge of the toner pattern on the drum 2 has moved away from the transfer roller 13. Increasing the above duration is successful to increase the cleaning time either sequentially or stepwise. With this scheme, it is possible to maintain the surface of the transfer roller 13 clean at all times and therefore to preserve the initial performance of the roller 13.

As stated above, in the second to eighteenth constructions, the voltage applying means increases, with an increase in the duration of use of the transfer roller 13, the duration of the voltage of second polarity (negative in the embodiment) applied to the transfer roller or transfer member 13 after the trailing edge of the toner pattern has moved away from the roller 13. Let this construction be referred to as a nineteenth construction.

Figure 16:
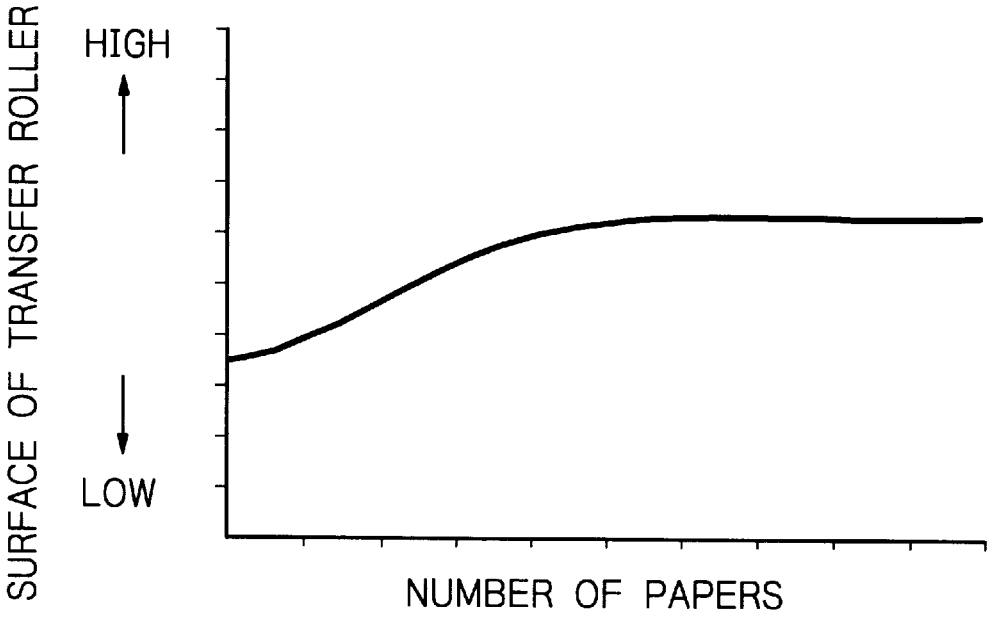
FIG. 16 is a graph indicating that the resistance of the transfer roller increases due to aging.

As shown in FIG. 16, the resistance of the transfer roller 13 increases with the elapse of time, i.e., with an increase in the number of papers conveyed via the roller 13 due to toner and paper dust deposited on the roller 13. On the other hand, as for the application of the voltage to the transfer roller 13, there are available a constant voltage system maintaining the voltage constant and a constant current system maintaining the current constant. The illustrative embodiment is practicable with either one of such two systems. Assume that the constant current system is used and that the resistance of the transfer roller 13 increases, as shown in FIG. 16. Then, the voltage to be applied to the transfer roller 13 also sequentially increase.

However, the toner forming the toner pattern on the drum 2 contains, if not much, toner charged to polarity (positive polarity in the embodiment) opposite to the expected polarity. Such toner of opposite polarity is transferred from the drum 2 to the transfer roller 13 to which a higher negative voltage is applied. Moreover, because the negative voltage is continuously applied to the transfer roller 13 even during cleaning, the toner of opposite polarity electrostatically transferred to the roller 13 remains thereon even during cleaning. When a toner image formed on the drum 2 is transferred to a paper, the positive voltage is applied to the transfer roller. As a result, the toner of opposite polarity is transferred from the transfer roller 13 to the rear of the paper and smears it.

Figure 17:
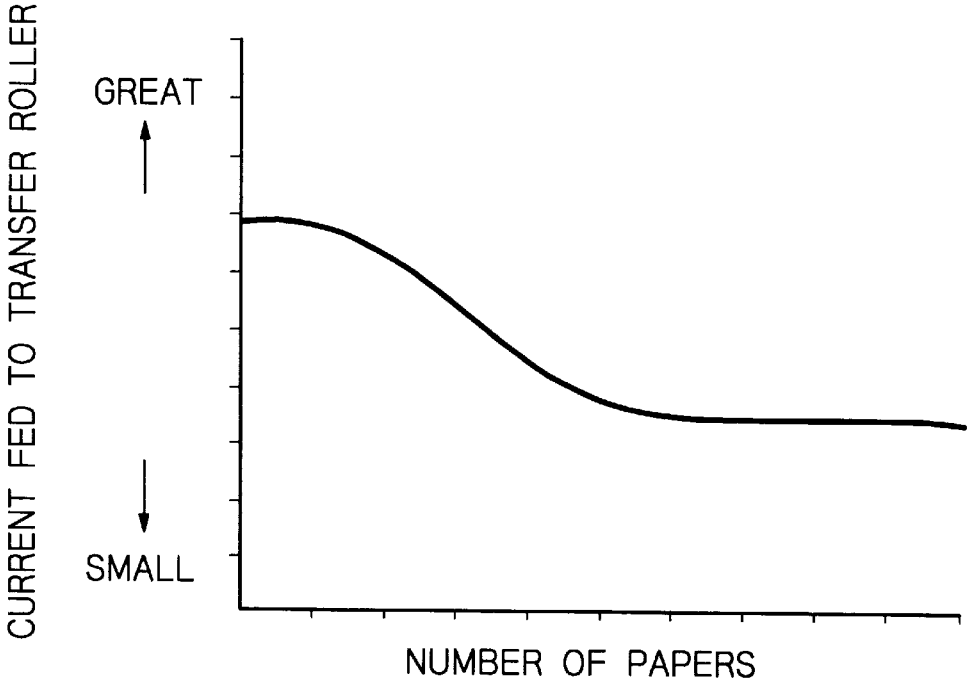
FIG. 17 is a graph showing a specific operation for varying a current to be fed to the transfer roller.

In light of the above, when the toner pattern is moved between the drum and the transfer roller 13 and when the roller 13 is cleaned afterwards, i.e., when the voltage of second polarity or negative polarity is applied to the roller 13, the absolute value of the current to be fed to the roller 13 may be reduced with an increase in the number of papers, i.e., the duration of use of the roller 13, as shown in FIG. 17. In such a configuration, even when the resistance of the transfer roller 13 increases due to aging, the current is prevented from excessively increasing when the negative voltage is applied to the roller 13. As a result, a minimum of toner of opposite polarity is transferred to the transfer roller 13. Such toner, if transferred to the transfer roller 13, can be returned to the drum 2 at the time of cleaning, so that the rear of a paper is free from contamination.

As stated above, in the first to nineteenth constructions, the voltage applying means applies a voltage to the transfer roller or transfer member 13 such that the value of the current to be fed to the roller 13 decreases with an increase in the duration of use of the roller 13. Let this construction be referred to as a twentieth construction.

Figure 18:
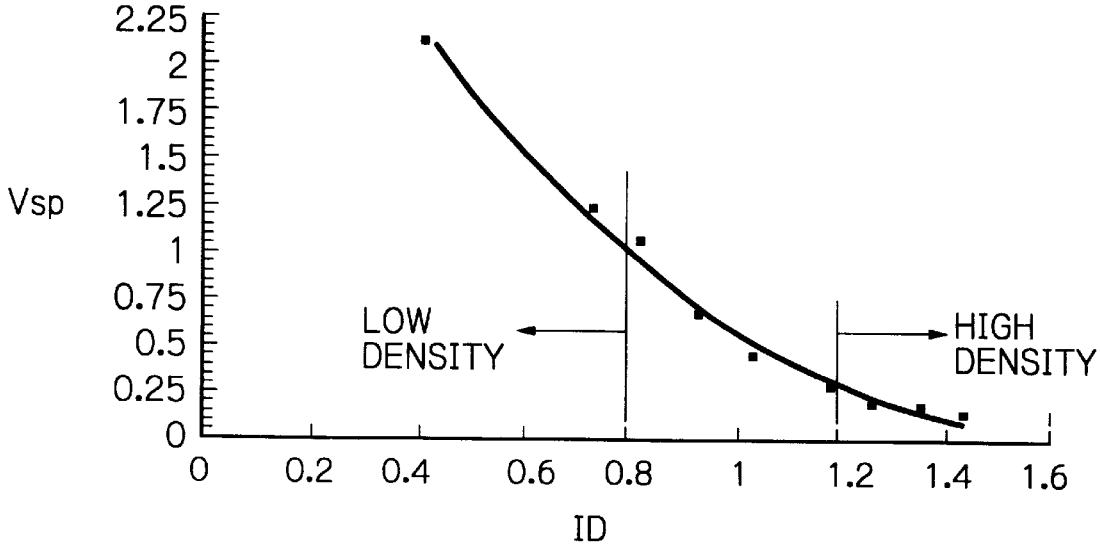
FIG. 18 is a graph showing a specific relation between the density of the toner pattern and the output voltage of the optical sensor.

The relation between the density ID of the toner pattern and the output voltage Vsp of the sensor 15 representative of the density ID depends on the kind or type of the sensor 15, as stated with reference to FIG. 10 specifically. FIG. 18 shows another specific relation between the density ID and the voltage Vsp. As shown, in a high density range in which the density ID is above 1.2 inclusive, the voltage Vsp changes little for a change in density ID. When the density ID is sensed in such a range, it is difficult to accurately detect slight changes in density ID. In a low density range in which the density ID is below 0.8 inclusive, the voltage Vsp varies excessively for a change in density ID. It is therefore likely that the bias voltage applied to the developing roller 12 becomes irregular or that the surface potential of the latent image representative of the toner pattern becomes irregular, causing the voltage Vsp to vary noticeably. This prevents the density of the toner pattern from being sensed with accuracy.

Therefore, in FIG. 18, it is preferable to provide the toner pattern with density ID of 1.0 or therearound and to sense such density. Assume the image forming apparatus shown in FIG. 1 which scans the charged drum 2 with the laser beam to form a latent image representative of a toner pattern and develops it to produce the toner pattern. Also, assume that to form the toner pattern whose density ID is around 1.0, the apparatus scans the drum 2 with the laser beam in the form a dot pattern and develops the dot pattern. Then, the resulting toner pattern includes portions where toner exists in the form of dots and portions where no toner exists. When the sensor 15 senses such a toner pattern, it is likely that the density is determined to be low despite that the toner pattern is dark or to be high despite that it is light. Preferably, therefore, the latent image representative of the toner pattern should not be implemented as a dot pattern, but should be formed by the full turn-on of the laser. In such a case, the surface potential of the latent image and the bias voltage to be applied to the developing roller 12 are usually reduced in absolute value, compared to the time of formation of a usual toner image. For example, the surface potential of the latent image and the bias voltage assigned to the developing roller 12 are respectively selected to be −100 V and −400 V, so that a toner pattern of relatively low density is formed by an image forming potential of 300 V.

Figure 19:
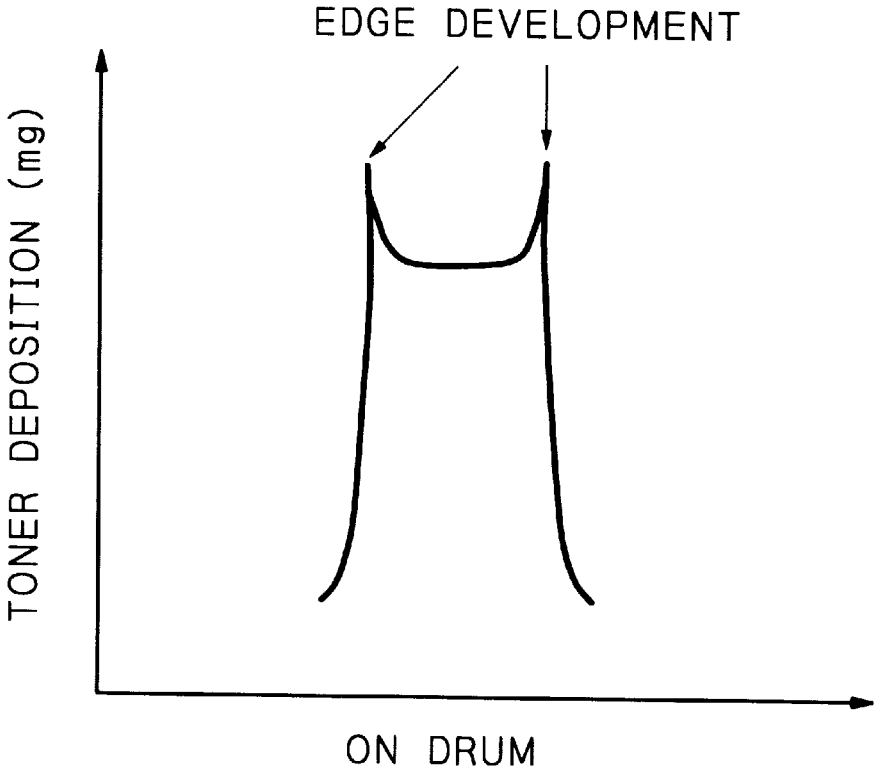
FIG. 19 is a graph demonstrating the edge development of the toner pattern.

The toner pattern entirely painted by the toner, as distinguished from the dot toner pattern, allows the image density to be accurately sensed, as stated above. This, however, brings about another problem that, as shown in FIG. 19, a greater amount of toner deposits on the edges of the toner pattern than on the intermediate portion. Assume that the toner pattern with such a toner distribution is between the drum 2 and the transfer roller 13. Then, despite that the voltage of the same polarity as the toner is applied to the transfer roller 13, the toner is transferred from the edges of the toner pattern to the roller 13 and cannot be easily removed from the roller 13 at the time of cleaning. That is, although the density ID of the entire toner pattern is relatively low, the toner existing at the edges of the toner pattern deposits on the transfer roller 13.

Figure 20:
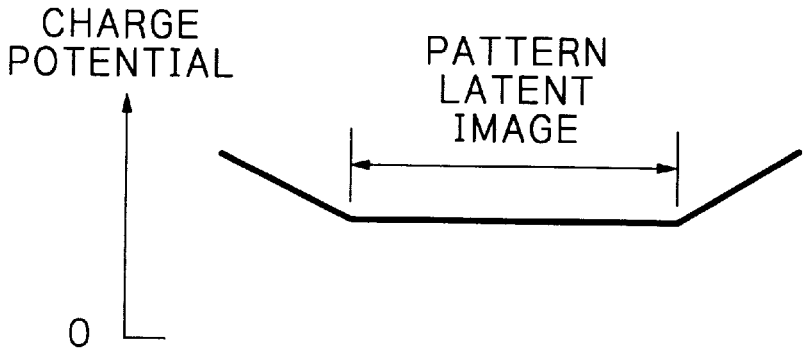
FIG. 20 shows a specific operation for adjusting a surface potential around the toner pattern.

To solve the above problem, as shown in FIG. 20, the charge potential distribution on the drum 2 is set up such that the surface potential around the latent image representative of a toner pattern sequentially approaches the surface potential of the latent image toward the latent image. In this condition, when the latent image is developed by the developing device 10 to turn out a toner pattern, the conspicuous edge development shown in FIG. 19 is obviated. Consequently, the toner existing at the edges of the toner pattern is prevented from depositing on the transfer roller 13 or is, if deposited, easily returned to the drum 2 at the time of cleaning.

A specific approach to achieve the potential distribution on the drum 2 shown in FIG. 20 is as follows. While the charge roller 3 uniformly charges the surface of the drum 2, the laser issuing from the optical writing device 4 scans the drum 2 with its quantity or intensity adjusted.

As stated above, in the first to twentieth constructions, the above latent image forming means adjusts the potential of the drum or image carrier 2 such that the surface potential around a latent image representative of a toner pattern sequentially approaches the surface potential of the latent image toward the latent image. Let this construction be referred to as a twenty-first construction.

Figure 21:
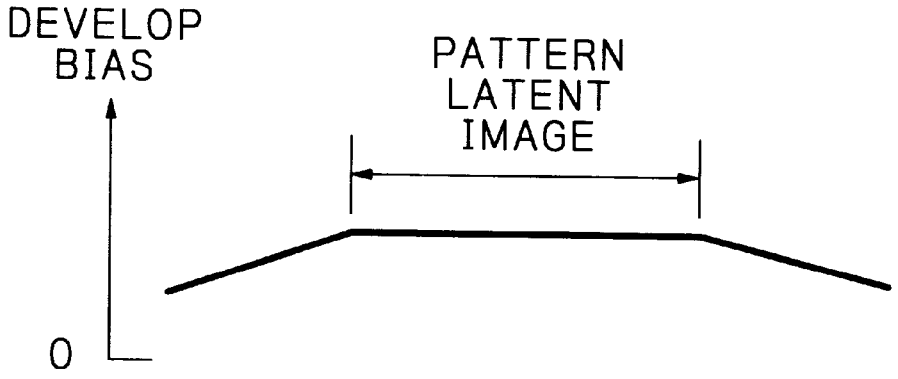
FIG. 21 shows a specific operation for adjusting a bias voltage.

In place of or in parallel with the above measure against edge development, the developing ability may be made lower for the portions of the drum 2 preceding and following the latent image representative of the toner pattern in the circumferential direction of the drum 2 than for the latent image itself. This is also successful to reduce edge development and to allow a minimum of toner forming the toner pattern to deposit on the transfer roller 13. For example, as shown in FIG. 21, the bias voltage applied to the developing roller 12 is made lower in absolute value when the portions of the drum 2 around the latent image representative of a toner pattern is brought to the roller 12 than when the latent image itself is brought to the roller 12. Stated another way, a bias voltage distribution is set up such that the absolute value of the bias voltage applied to the developing roller 12 when the portions preceding and following the latent image each each is brought the roller 12 sequentially approaches the absolute value of the bias voltage applied to the roller 12 for the development of the latent image.

As stated above, in the first to twenty-first constructions, the above developing device 10 develops a latent image representative of a toner pattern such that its developing ability is lower for the portions of the drum or image carrier 2 preceding and following the latent image than for the latent image. Let this construction be referred to as a twenty-second construction.

In the specific constructions described in relation to FIG. 18, the density ID of the toner pattern is selected to be around 1.0. With such relatively low density ID, it is possible to prevent the toner forming the toner pattern from easily depositing on the transfer roller 13, as stated earlier.

Figure 22:
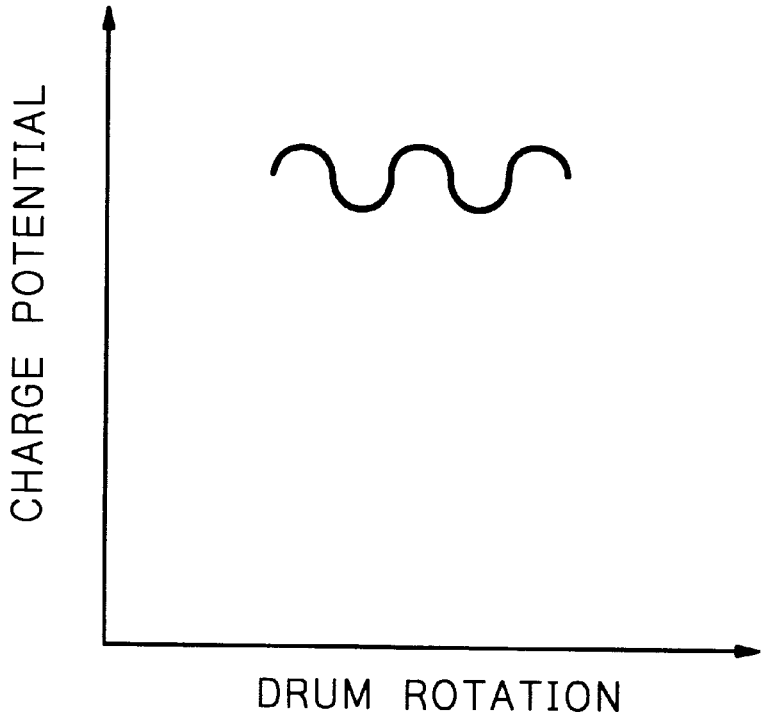
FIG. 22 shows how ripples occur on the surface of a charged photoconductive element.

The basic operation and effects of the present invention are achievable by applying a voltage of any polarity to the transfer roller 13 or by applying no voltage to the roller 13 except when a toner image is transferred from the drum 2 to a paper and when a toner pattern on the drum 2 is brought to the roller 13. However, assume that when the surface portion of the drum 2 where a latent image representative of a toner pattern is to be formed is moved between the drum 2 and the transfer roller 13, a voltage opposite in polarity to the charge deposited on the drum 2 (positive polarity in the embodiment) is applied to the roller 13. Then, the above surface portion of the drum 2 is charged to positive polarity by the transfer roller 13. When this surface portion is illuminated by the discharge lamp 21, the positive charged deposited there cannot be dissipated by the lamp 21 because the drum 2 is not sensitive to the positive side. Subsequently, the surface portion is charged to negative polarity by the charge roller 3. However, due to the positive charge left on the surface portion, the surface potential of the drum 2 moved away from the charge roller 3 has ripples, as shown in FIG. 22. The resulting toner pattern is irregular in density.

So long as the difference between the surface potential of the drum 2 and the bias voltage assigned to the developing roller 12, i.e., the image forming potential is as high as during the formation of a usual toner image, the ripples shown in FIG. 22 have little influence. However, when the difference between the surface potential of a latent image representative of a toner pattern and the bias voltage assigned to the developing roller 12 is reduced, the resulting toner pattern suffers from irregular tonality due to the influence of the ripples. Should the sensor 15 sense the density of such an irregular toner pattern, the sensing accuracy would be lowered.

A specific solution for the above problem is as follows. When the surface portion of the drum 2 where a latent image representative of a toner pattern is to be formed is passed through the nip between the drum 2 and the transfer roller 13, a voltage of the same polarity (negative in the embodiment) as the charge of the drum 2 is applied to the roller 13, or alternatively a voltage of 0 V is applied to the roller 13. In this condition, when the above surface portion of the drum 2 is brought to the discharge lamp 21, its surface potential is uniformly lowered by the lamp 21. As a result, the surface portion of the drum 2 is free from the ripples of FIG. 22 when charged by the charge roller 3. The resulting toner pattern is therefore free from irregular tonality, enhancing the sensing accuracy of the sensor 15.

As stated above, in the first to twenty-second constructions, the above voltage applying means applies, when the surface portion of the drum or image carrier 2 where a latent image representative of a toner pattern is to be formed is brought to the transfer roller or transfer member 13, a voltage of the same polarity as the charge of the drum 2 or a voltage of 0 V to the roller 13 is applied to the roller 13. Let this construction be referred to as a twenty-third construction.

Figure 23:
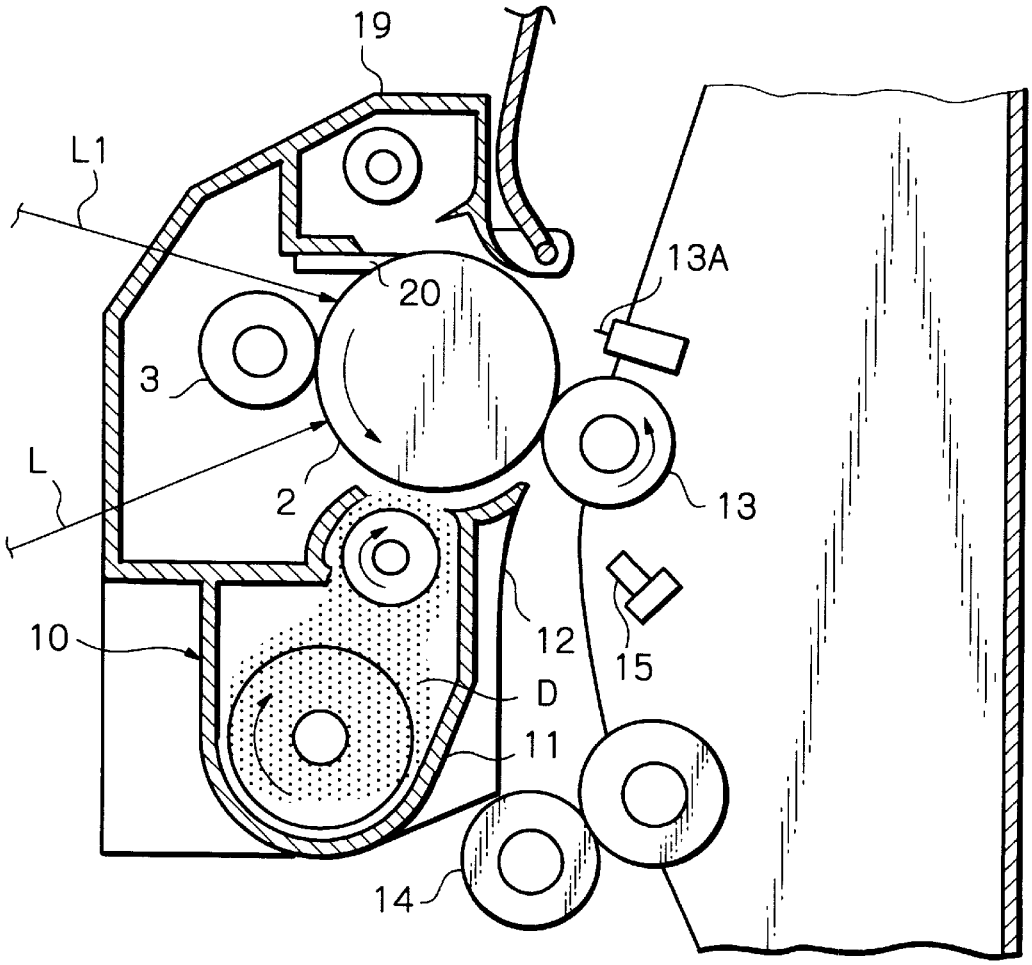
FIG. 23 is a section showing an alternative embodiment of the present invention.

The specific constructions shown and described are similarly applicable to various kinds of image forming apparatuses other than the apparatus shown in FIG. 1, e.g., one shown in FIG. 23. In FIG. 23, the same or similar structural elements as the structural elements of FIG. 1 are designated by identical reference numerals. As shown, while the drum or image carrier 2 is rotated counterclockwise, as viewed in FIG. 23, the charge roller or charger 3 uniformly charges the surface of the drum 2 to preselected polarity, i.e., negative polarity in the specific construction. An optical writing device, not shown, scans the charged surface of the drum 2 with a laser beam L in order to form a latent image in accordance with image data. The latent image is developed by the developer D being conveyed by the developing roller 12 of the developing device 10. The resulting toner image is transferred from the drum 2 to a paper, not shown, conveyed by the registration roller pair 14 to the nip between the transfer roller 13 and the drum 2. The transfer roller 13 is rotated while pressing itself against the drum 2 with a preselected pressure. A separator in the form of an electrode needle 13A separates the paper carrying the toner image from the drum 2. Then, the paper is conveyed to a fixing unit, not shown, to have the toner image fixed thereon. The toner left on the drum 2 after the image transfer is removed by the cleaning blade 20. Subsequently, the surface of the drum 2 is illuminated by light L emitted from a discharge lamp, not shown.

A particular toner pattern is formed on the drum 2 at a timing not obstructing the formation of the above toner image. The sensor 15 senses the density of the toner pattern. If the density sensed by the sensor 15 is low, then toner is replenished from a toner container, not shown, to the casing 11 of the developing device 10.

The apparatus shown in FIG. 23 is therefore basically identical with the apparatus shown in FIG. 1. After the apparatus shown in FIG. 24 has formed a toner pattern on the drum 2 at the rear of a toner image in the direction of rotation of the drum 2, the toner content of the developer D is determined on the basis of a ratio of the density of the toner pattern to the density of the portion around the toner pattern. This will be described with reference to FIG. 24.

Figure 24:
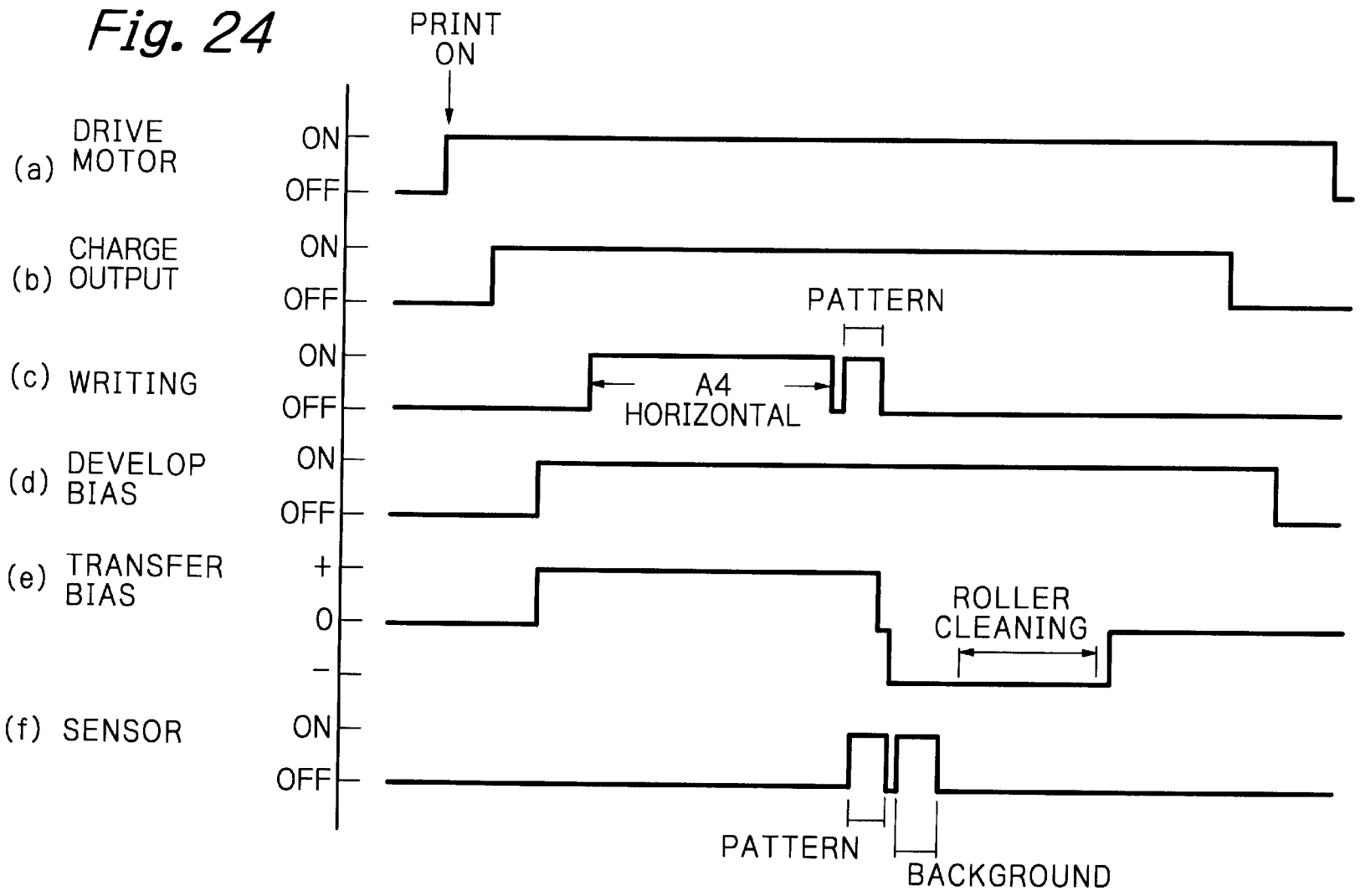
FIG. 24 is a timing chart demonstrating a specific operation of the alternative embodiment.

FIG. 24 shows a specific procedure in which a paper of size A4 is fed in a horizontally long position in order to form a toner image on the paper and then form a toner pattern at the rear of the toner image. As shown, when a print start key, not shown, is turned on (Print On), the drum 2 starts rotating in synchronism with the rotation of a drive motor or main motor, not shown ((a), FIG. 24). When the drum 2 reaches a constant speed, a negative voltage is applied to the charge roller 3((b), FIG. 24) so as to charge the drum 2 to negative polarity. The optical writing unit forms a latent image on the charged surface of the drum 2 ((c), FIG. 24). When the charged region of the drum 2 arrives at the developing device 10, a negative bias voltage is applied to the developing roller 12 ((d), FIG. 24) in order to develop the latent image. The resulting toner image is transferred to the paper conveyed between the drum 2 and the transfer roller 13. At this instant, a positive voltage is applied to the transfer roller 13 substantially at the same time as the bias voltage is applied to the developing roller 12 or when the leading edge of the toner image arrives at the transfer roller 13 ((e), FIG. 24). The bias voltage is continuously applied to the transfer roller 13 until the leading edge of the paper moves away from the transfer roller 13. As a result, the toner image is transferred from the drum 2 to the paper. Thereafter, a negative bias voltage is applied to the transfer roller 13 in place of the positive bias voltage.

Figure 25:
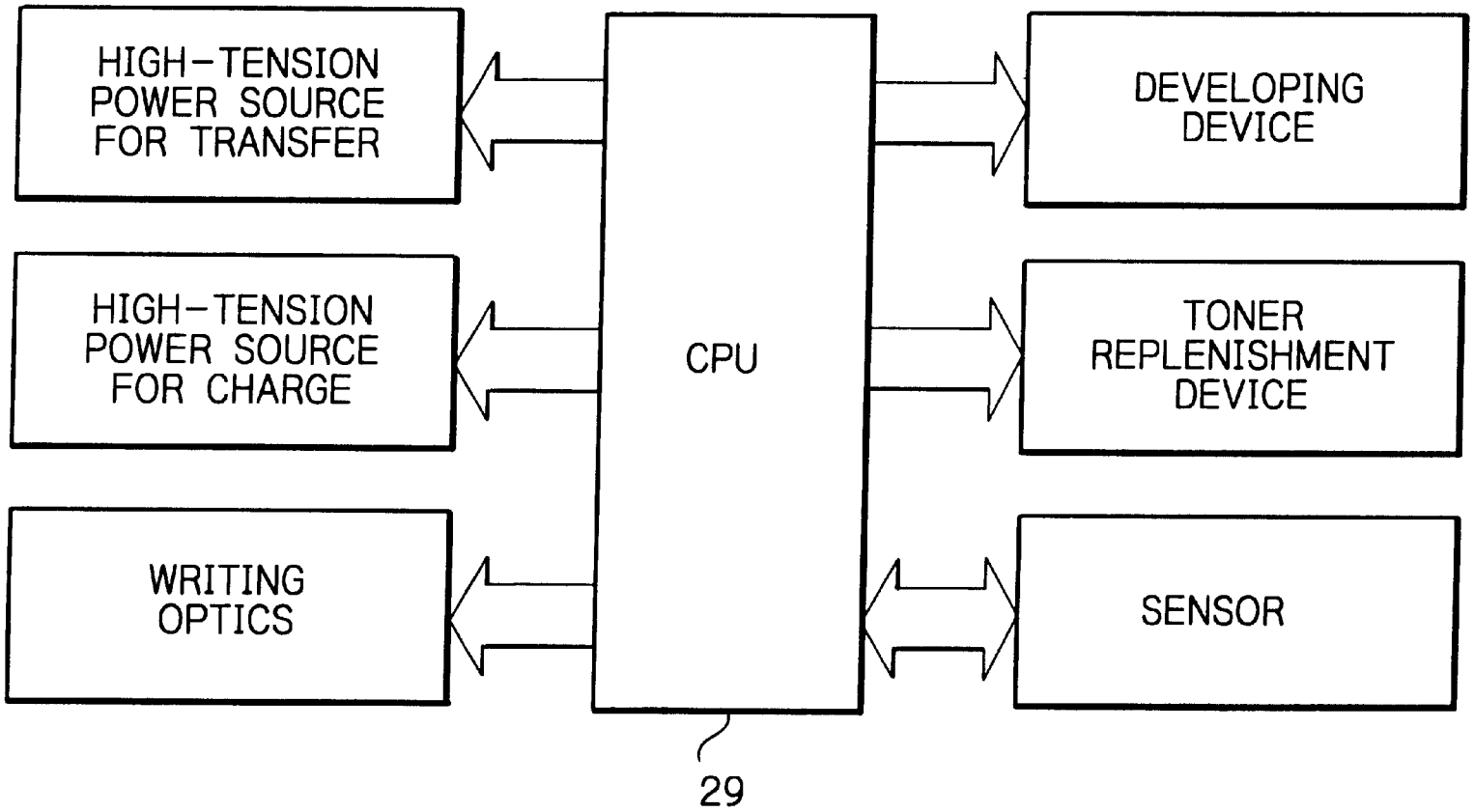
FIG. 25 is a block diagram schematically showing a control system included in the alternative embodiment.

After the toner image, a latent image representative of the particular pattern is formed on the drum 2 and then developed by the developing device. The sensor senses the density of the resulting toner pattern (labeled Pattern in FIG. 24). Subsequently, the sensor 15 senses the reflection density of the portion of the drum 2 charged and applied with the bias voltage, but not scanned by the laser beam L (labeled Background in FIG. 24). The sensor 15 sends the density of the toner pattern and that of the background to the main controller 29, FIG. 25, including the CPU. If the ratio of the density of the toner pattern to the density of the background is not coincident with a target value, the main controller 29 causes a toner replenishing section, not shown, to replenish toner to the developing device 10.

When the toner pattern is brought to the transfer roller 13, a voltage of the same polarity as the toner forming the toner pattern is applied to the transfer roller 13 in order to prevent the toner from depositing on the roller 13. Even after the toner pattern has moved away from the transfer roller 13, the above voltage is continuously applied in order to return the toner, if deposited on the roller 13, to the drum 2.

All the specific constructions described previously are applicable also to the apparatus shown in FIG. 23.

In the apparatus shown in FIG. 23, the drum 2 is provided with a diameter of less than 40 mm for a compact configuration. However, the sensor 15 can be spaced from the drum 2 by a distance of more than 15 mm, e.g., 20 mm. The sensor 15 can therefore be built in a miniature image forming apparatus.

The present invention is applicable even to an image forming apparatus of the type transferring a toner image from an image carrier to an intermediate transfer body and then transferring it to a paper or similar recording medium. In this type of apparatus, the intermediate transfer body constitutes a transfer medium to which the toner image is transferred from the image carrier. If desired, the photoconductive drum may be replaced with a photoconductive bent passed over a plurality of spaced pulleys or with an image carrier other than a photoconductor.

Further, the present invention is applicable also to an analog image forming apparatus forming a latent image on an image carrier with focusing optics. In this analog apparatus, a reference pattern image is focused onto the image carrier by the optics in order to form a latent image, and then the latent image is developed by a developing device to turn out a toner pattern.

In summary, it will be seen that the present invention provides an image forming apparatus achieving various unprecedented advantages, as enumerated below.

(1) Even when a toner pattern is brought to a transfer member, the transfer member is not released from an image carrier. This eliminates the need for the conventional device for releasing the transfer member from the image carrier at the above instant and therefore reduces the cost of the apparatus. In addition, there is obviated an occurrence that toner deposited on the transfer member smears a recording medium.

(2) Toner, if transferred from the toner pattern to the transfer member, is returned to the image carrier, so that the transfer member remains clean.

(3) The transfer member is cleaned during at least one rotation thereof. The transfer member can therefore be cleaned more positively.

(4) When toner deposited on the transfer member cannot be fully removed by at least one rotation of the transfer member, it is possible for the operator to see such a situation. Further, such toner can be fully removed by the subsequent cleaning operation. In addition, even when the transfer member is deteriorated, it can be sufficiently cleaned.

(5) The transfer of the toner forming the toner pattern on the drum to the transfer member can be effectively obstructed.

(6) When the density of the toner pattern is determined to be lower than a reference density, toner is replenished to a developing device before the development of a usual toner image. Therefore, a toner image with stable density can be produced from the beginning.

(7) Toner is prevented from being replenished to the developing device in an excessive amount.

(8) The operator can be informed of the fact that toner must be replenished to a toner replenishing section communicated to the developing device.

(9) The toner pattern is formed during warm-up time necessary for a heat roller to reach its preselected temperature, and formed only when the temperature of the heat roller is below the preselected temperature. Therefore, the timing for starting forming a usual toner image is not delayed.

(10) There is obviated an occurrence that the toner pattern is wastefully formed a number of times and aggravates the fatigue of the transfer member.

(11) When toner should be replenished to the toner replenishing section, the toner pattern is necessarily formed, and a toner replenishing operation is executed. This insures a toner image of adequate density at all times.

(12) Even when a plurality of toner patterns are formed n the image carrier, the cleaning time assigned to the transfer member is prevented from wastefully increased.

(13) Even when the transfer member is used over a long period of time, defective cleaning is obviated.

(14) The defective cleaning of the transfer member is eliminated even when the density of the toner pattern is unusually high.

(15) When the density of the toner pattern is unusually low, the cleaning time assigned to the transfer member is reduced in order to prevent the deterioration of the transfer member from being accelerated.

(16) The transfer member can be effectively cleaned even when its surface is roughened due to aging.

(17) The deposition of toner on the transfer member is reduced even when the resistance of the transfer member increases due to aging.

(18) The toner is prevented from depositing on the edges of the toner pattern in a great amount and being transferred to the transfer member.

(19) The toner pattern is free from irregular density and can have its density accurately sensed.

Various modifications will become possible for those skilled in the art after receiving the teachings of the present disclosure without departing from the scope thereof.

What is claimed is:

1. An image forming apparatus comprising:

an image carrier driven such that a surface thereof moves;

latent image forming means for forming a latent image representative of a document and a latent image representative of a particular pattern on said image carrier;

a developing device for developing the latent image representative of the document image and the latent image representative of the particular pattern to thereby produce a corresponding toner image and a corresponding toner pattern, respectively;

a transfer member contacting the surface of said image carrier via a recording medium, for transferring the toner image from said surface of said image carrier to said recording medium;

density sensing means for sensing a density of the toner pattern formed on the surface of said image carrier; and voltage applying means for applying, when the toner image is transferred from the surface of said image carrier to a surface of the recording medium being moved between said image carrier and said transfer member, a voltage of first polarity opposite to a polarity of a charge of toner forming said toner image to said transfer member and for applying, when the toner pattern is moved between said image carrier and said transfer member contacting the surface of said image carrier, a voltage of second polarity identical to a charge polarity of toner forming said toner pattern to said transfer member.

2. An apparatus as claimed in claim 1, wherein said voltage applying means continuously applies the voltage of second polarity to said transfer member until a preselected time expires since a leading edge of the toner pattern has moved away from said transfer member.

3. An apparatus as claimed in claim 2, wherein said voltage applying means continuously applies the voltage of second polarity to said transfer member over a period of time, since the leading edge of the toner pattern has moved away from said transfer member, which increases with an increase in a duration of use of said transfer member.

4. An apparatus as claimed in claim 1, wherein said transfer member comprises a rotary body rotatable in contact with the surface of said image carrier, said voltage applying means continuously applying the voltage of second polarity to said transfer member during an interval between a leading edge of the toner pattern moves away from said transfer member and a time when said transfer member completes at least one rotation.

5. An apparatus as claimed in claim 4, wherein a sensing position where said density sensing means senses the surface of said image carrier is located downstream of a developing region assigned to said developing device, but upstream of a transfer region assigned to said transfer member, in a direction in which the surface of said image carrier moves.

6. An apparatus as claimed in claim 5, further comprising image carrier drive control means for reversing, after application of the voltage of second polarity to said transfer member has been stopped, the direction of movement of the surface of said image carrier to thereby allow said density sensing means to sense a condition of deposition of toner returned from said transfer member to said image carrier.

7. An apparatus as claimed in claim 6, wherein when said density sensing means determines that an amount of toner returned from said transfer member to said image carrier is greater than a reference amount, said transfer member is caused to make at least one additional rotation while the voltage of second polarity is applied to said transfer member by said voltage applying means.

8. An apparatus as claimed in claim 6, wherein when said density sensing means determines that an amount of toner returned from said transfer member to said image carrier is greater than a first reference voltage, but smaller than a second reference voltage greater than said first reference voltage, said transfer member is caused to make at least one additional rotation while a first voltage of second polarity is applied to said transfer member by said voltage applying means, or when said density sensing means determines that said amount of toner is greater than said second reference voltage, said transfer member is caused to make at least one additional rotation while a second voltage of second polarity higher in absolute value than said first voltage is applied to said transfer member by said voltage applying means.

9. An apparatus as claimed in claim 1, wherein said voltage applying means starts applying the voltage of second polarity to said transfer member before a leading edge of the toner pattern formed on the surface of said image carrier reaches said transfer member.

10. An apparatus as claimed in claim 1, wherein said developing device stores a two-ingredient type developer consisting of toner and carrier.

11. An apparatus as claimed in claim 10, wherein said latent image forming means and said developing device forms the toner pattern on the surface of said image carrier during a warm-up time before the toner image begins to be formed on the surface of said image carrier, said apparatus further comprising toner replenishing means for replenishing, when said density sensing means determines that a density of said toner pattern is lower than a preselected density, toner to said developing device before said toner image begins to be formed on the surface of said image carrier.

12. An apparatus as claimed in claim 11, wherein when said density sensing means determines that the density of the toner pattern is lower than the preselected density, said latent image forming means and said developing device forms an additional toner pattern on the surface of said image carrier at least once before formation of the toner image begins, said toner replenishing means replenishing, when said density sensing means determines that a density of said additional toner pattern is also lower than said preselected density, the toner to said developing device before formation of said toner image, and wherein said voltage applying means applies, even when said additional toner pattern is moved between said image carrier and said transfer member contacting said image carrier, the voltage of second polarity identical with a charge polarity of toner forming said additional toner pattern to said transfer member.

13. An apparatus as claimed in claim 12, further comprising control means for determining, when said density sensing means determines that the density of the additional toner pattern is lower than the preselected density even after a plurality of times of toner replenishment, that toner should be replenished to a toner replenishing section communicated to said developing device.

14. An apparatus as claimed in claim 11, further comprising a heat roller for fixing the toner image transferred to the recording medium, and temperature sensing means for sensing a temperature of said heat roller.

15. An apparatus as claimed in claim 14, wherein said latent image forming means and said developing device form the toner pattern on the surface of said image carrier when said temperature sensing means determines that the temperature of said heat roller is lower than a preselected temperature.

16. An apparatus as claimed in claim 1, further comprising counting means for counting a number of times of toner image formation repeated, said latent image forming means and said developing apparatus forming the toner pattern on the surface of said image carrier when said counting means counts a preselected number of times of toner image formation.

17. An apparatus as claimed in claim 1, further comprising:

counting means for counting a number of times of toner image formation repeated;

a heat roller for fixing the toner image transferred to the recording medium; and temperature sensing means for sensing a temperature of said heat roller;

said latent image forming means and said developing device forming, when said counting means counts a preselected number of times of toner image formation and when said temperature sensing means determines that the temperature of said heat roller is below a preselected temperature after a power-up of said apparatus, the toner pattern on the surface of said image carrier before formation of the toner image on said surface of said image carrier.

18. An apparatus as claimed in claim 17, wherein when a condition wherein toner should be replenished to a toner replenishing section communicated to said developing device is detected, said latent image forming means and said developing device form the toner pattern on the surface of said image carrier without regard to the temperature of said heat roller or the number of times of toner image formation.

19. An apparatus as claimed in claim 1, wherein said latent image forming means and said developing device sequentially forms a plurality of toner patterns on the surface of said image carrier in a direction of movement of the surface of said image carrier, a toner pattern of highest density being first.

20. An apparatus as claimed in claim 1, wherein said latent image forming means and said developing device decrease the density of the toner pattern to be formed on the surface of said image carrier with an increase in a number of times of toner image formation repeated.

21. An apparatus as claimed in claim 1, wherein when said density sensing means determines that the density of the toner pattern is unusually high, said voltage applying means increases a duration of the voltage of second polarity to be applied to said transfer member.

22. An apparatus as claimed in claim 1, wherein when said density sensing means determines that the density of said toner pattern is unusually low, said voltage applying means reduces a duration of the voltage of second polarity to be applied to said transfer member.

23. An apparatus as claimed in claim 1, wherein said voltage applying means applies a voltage to said transfer member such that a current to be fed to said transfer member decreases with an increase in a duration of use of said transfer member.

24. An apparatus as claimed in claim in claim 1, wherein said latent image forming means adjusts a potential of the surface of said image carrier such that a surface potential of said image carrier around the latent image representative of the toner pattern sequentially approaches a surface potential of said latent image toward said latent image.

25. An apparatus as claimed in claim 1, wherein said developing device develops the latent image representative of the toner pattern such that a developing ability falls when developing portions respectively preceding and following said latent image than when developing said latent image.

26. An apparatus as claimed in claim 1, wherein when a portion of said image carrier where the latent image representative of the toner pattern is to be formed is moved between said image carrier and said transfer member, said voltage applying means applies a voltage identical in polarity with a charge of said image carrier or a voltage of 0 V to said transfer member.

27. An image forming apparatus comprising:

an image carrier having a moving surface;

an optical writing device cooperating with a charge roller to form a latent image representative of a document and a latent image representative of a particular pattern on said image carrier;

a developing device for developing the latent image representative of the document image and the latent image representative of the particular pattern to thereby produce a corresponding toner image and a corresponding toner pattern, respectively;

a transfer member contacting the surface of said image carrier via a recording medium, for transferring the toner image from said surface of said image carrier to said recording medium;

a sensor for sensing a density of the toner pattern formed on the surface of said image carrier; and a controller for causing a power source to apply to said transfer member a voltage of first polarity opposite to a polarity of a charge of toner forming said toner image when the toner image is transferred from the surface of said image carrier to a surface of the recording medium being moved between said image carrier and said transfer member, and to apply to said transfer member a voltage of second polarity identical to a charge polarity of toner forming said toner pattern when the toner pattern is moved between said image carrier and said transfer member contacting the surface of said image carrier.

* * * * *